US007757357B2

(12) United States Patent
Stewart et al.

(10) Patent No.: US 7,757,357 B2
(45) Date of Patent: Jul. 20, 2010

(54) ADJUSTABLE BUNDLING DEVICE

(76) Inventors: Anna M. Stewart, 692 Highland Ave., Atlanta, GA (US) 30312; Stephen Kraigh Stewart, 692 Highland Ave., Atlanta, GA (US) 30312

( * ) Notice: Subject to any disclaimer, the term of this patent is extended or adjusted under 35 U.S.C. 154(b) by 0 days.

(21) Appl. No.: 12/390,932

(22) Filed: Feb. 23, 2009

(65) Prior Publication Data

US 2009/0151130 A1 Jun. 18, 2009

Related U.S. Application Data

(63) Continuation of application No. 11/120,922, filed on May 3, 2005, now Pat. No. 7,513,017.

(60) Provisional application No. 60/567,742, filed on May 3, 2004.

(51) Int. Cl.
*B65D 63/10* (2006.01)

(52) U.S. Cl. ..... 24/16 PB; 24/30.5 P; 24/17 AP

(58) Field of Classification Search ..... None
See application file for complete search history.

(56) References Cited

U.S. PATENT DOCUMENTS 3,086,265 A * 4/1963 Orenick et al. ..... 24/30.5 P
6,226,839 B1 * 5/2001 Sayegh ..... 24/16 PB
6,594,867 B1 * 7/2003 Pettersson ..... 24/16 PB

* cited by examiner

*Primary Examiner*—Jack W. Lavinder
(74) *Attorney, Agent, or Firm*—Gregory Scott Smith

(57) ABSTRACT

An adjustable bundling device is disclosed that aids in the cinching and un-cinching of one or more items, such as the wrapping of food items in preparation for cooking. A cavity element and a stop element are attached to opposing ends of a length of flexible textured cord. The cord can be pushed through the cavity to form a loop that can hold various items. The loop can be tightened and loosened by sliding the cord within the cavity. The texture of the cord interacts with protrusions in the cavity to lock the cord in place. The cavity acts a type of clench and the end stop prevents the cord from slipping all the way out of the cavity.

15 Claims, 42 Drawing Sheets

ADJUSTABLE BUNDLING DEVICE

CROSS-REFERENCE TO RELATED APPLICATIONS

This application is a continuation of United States application for patent that was filed on May 3, 2005 now U.S. Pat. No. 7,513,017 and assigned Ser. No. 11/120,922, which application has been allowed and, which application claims priority to United States Provisional Application for patent filed on May 3, 2004 and assigned Ser. No. 60/567,742, which are incorporated herein in its entirety.

BACKGROUND

The present invention relates to an adjustable bundling device for holding together one or more items and to the method of making and using the adjustable bundling device.

Bundling devices, also known as cinching devices or trussing devices, facilitate cinching, bundling, rolling, stuffing, securing, holding and the like, of edible items, e.g. meats, fish, fruits and vegetables, as well as other items.

Since ancient times, cooking certain items has presented challenges. Items that tend to break apart during the cooking process present one of those challenges, such as poultry that is baked in the oven. One solution for poultry pertains to using a truss.

To truss means to secure poultry or meat into a compact shape. To truss poultry with string, you take a piece of butcher's string about three times the length of the bird, places the bird on its back, with the tail end nearest to you. You then slide the string underneath so that it is cradling the bird in the center of its back. You then gently pull the string up the sides, then around the wings of the bird. Pull the strings toward you, close to the breast of the bird, so that the wings are held against the body of the bird. Cross the strings at the base of the breast of the bird; then wrap each string around the end of a drumstick. Tie the ends of the string together, cinching it tightly so that the legs cross. Then lift the bird so that the tail end is up and wrap the string around the tail. Tie the string, pulling tightly so that the cavity is covered by the tail. Place the bird on its back again and bring the string back to the front, then tie it off. The bird is now ready for the oven. This is a complicated and time-consuming process.

Previous attempts to simplify this process and to provide for trussing poultry, for example, include the following. U.S. Pat. No. 5,380,241, issued to Volk, teaches using a one piece and substantially coplanar thin plastic member. U.S. Pat. No. 3,877,109, issued to Moncrief, teaches a fowl spit roasting holder of bent bar with neck loop and leg and wing restraining sections.

Prior solutions to holding food, such as shown by the Sydlosky patent, U.S. Pat. No. 6,394,305, have been used to provide a way to hold food while transporting it from the baking pan to the carving area. Such provision for holding food is achieved by having the holding device placed underneath and on a plurality of sides of the food, e.g. a baking turkey, prior to the baking process, so that the food could be removed intact.

Another cooking challenge is the cooking of small items, especially on a grill. The problem with cooking small bits of food is that the food is hard to handle and the fire can easily burn a person's arms and hands if the person gets too close to the fire. Holding items together, such as food for cooking, has traditionally been accomplished by using string, toothpicks, skewers, large needles with thread, aluminum foil, and the like.

U.S. Pat. No. 2,935,013 to Onori discloses a skewer. Skewers of various designs are attempts to solve this challenge by mounting the food thereon so that it could all be handled at one time. The skewer also provides a handle which can be kept away from the fire so that the hand is not subject to getting burnt.

There are problems with these attempts to hold food for cooking. Using aluminum foil can contaminate the food and may scratch a Teflon coated pan. String and toothpicks may burn at the high cooking temperatures. Aluminum foil, string and toothpicks are generally not reusable. Using string, toothpicks or aluminum foil generally requires more than one hand. Sharp skewers or needles can be dangerous While these patents and other previous methods have attempted to solve the problem of holding food during the preparation and cooking process, none have employed a device that cinches and is reusable.

Therefore, a need exists for an improved holding device that can cinch instead of tying, be reusable, engage and disengage faster than conventional methods, utilize fewer hands in its operation, will not scratch Teflon coated pan, and will not burn below intermittent temperature of 850° F. and 750° F. sustained.

The foregoing patent and other information reflect the state of the art of which the inventor is aware and are tendered with a view toward discharging the inventor's acknowledged duty of candor in disclosing information that may be pertinent to the patentability of the present invention. It is respectfully stipulated, however, that the foregoing patent and other information do not teach or render obvious, singly or when considered in combination, the inventor's claimed invention.

SUMMARY

The general purpose of the present invention, which will be described subsequently in greater detail, is to provide a new device and method for effectively and efficiently holding items, such as, but not limited to, food. The present invention is intended to be used over and over again for cinching, bundling, rolling, stuffing, securing, holding and the like.

The main area of application for the present invention is for food items, e.g. meats, fish, fruits and vegetables. However, the present invention can also be used for the holding of most anything. In the kitchen or on the grill, the present invention replaces the need for the tying of kitchen twine, piercing with toothpicks or use of aluminum foil to hold stuffed foods.

One objective of the present invention is to provide an adjustable bundling device that will cinch one or more items together.

Another objective of the present invention is to provide an adjustable bundling device that is inexpensive.

Another objective of the present invention is to provide an adjustable bundling device that is easy to use.

Another objective of the present invention is to provide an adjustable bundling device that can be reused many times.

Another objective of the present invention is to provide an adjustable bundling device that is dishwasher safe.

Another object of this invention is to provide an adjustable bundling device which uses simple materials and components.

Another objective of the present invention is to provide an adjustable bundling device that adjusts for engaging a wide range of items.

Another objective of the present invention is to provide an adjustable bundling device with releasable locking in the desired position after engaging the desired item.

Another object of the present invention to create an adjustable bundling device operable for quick and easy clenching.

It a further object of the present invention to provide an adjustable bundling device that is easily reusable and washable.

It is yet another object of the present invention to provide an adjustable bundling device operable to allow for the easy tightening and loosening of items within the adjustable bundling device.

The present invention is comprised of a flexible cord portion, a sliding, tensioning portion operable for slideable, releasable locking, and an end portion. These portions are made of plastic, metal or other suitable material that retain their functionality and form at high temperatures, e.g. cooking.

The present in invention can be described as a tool or device that performs the function of holding, bundling, cinching, tying, rolling, securing, stuffing and the like in such environments as in the kitchen, the office, around the home, in the car, at work, at play, camping and the like. The unique method by which this tool performs is by way of a specially designed cavity that corresponds to a length of material described as a cord which, with applied finger pressure on said cord while holding the part known as the cavity, the two parts can then be forced together. The cord is attached to the cavity on one end and will fit into the cavity along its length. Depending on the direction in which the cord is inserted into the cavity will determine if the tool makes a noose shape or a loop shape. This shape can be pulled from the opposite of the cavity end to close the shape down tighter or be pushed through the cavity to open up the shape larger.

The size of the cavity in relation to the size of the cording is important due to the coefficient of friction that exists between the two sections. This can be expressed in percentages. The percentage the cavity section can be larger than the cord section is 10%. 0% would mean the cavity section and the cord section are the same diameter. The percentage smaller that the cavity section can be from the cord section is 40%. The durometer of the flexible compound is also a factor in the performance of the present invention. The more flexible the compound the smaller the cavity can be. The more rigid the material is the closer in size the cavity and the cord must be. This can also be described in terms of a percentage on the shore hardness A scale.

Another contributing factor that is necessary for the present invention's performance can be described as the amount of slippage or tacticity that is compounded into the flexible material. This is directly proportionate to the durometer of material formulation. The compound that makes the present invention work for food is a specially formulated and cross linked using FDA approved silicone blends that give the properties of High Temperature resistancy up to 750 degrees Fahrenheit sustained, and 850 degrees Fahrenheit intermittent. The formula for the compound will be retained as a trade secret.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further objects and advantages of the present invention will be apparent from the following detailed description of a presently preferred embodiment which is illustrated schematically in the accompanying drawings.

BRIEF DESCRIPTION OF THE SEVERAL VIEWS OF THE DRAWING

Other advantages and features of the invention are described with reference to exemplary embodiments, which are intended to explain and not to limit the invention, and are illustrated in the drawings in which.

DETAILED DESCRIPTION OF VARIOUS EMBODIMENTS

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
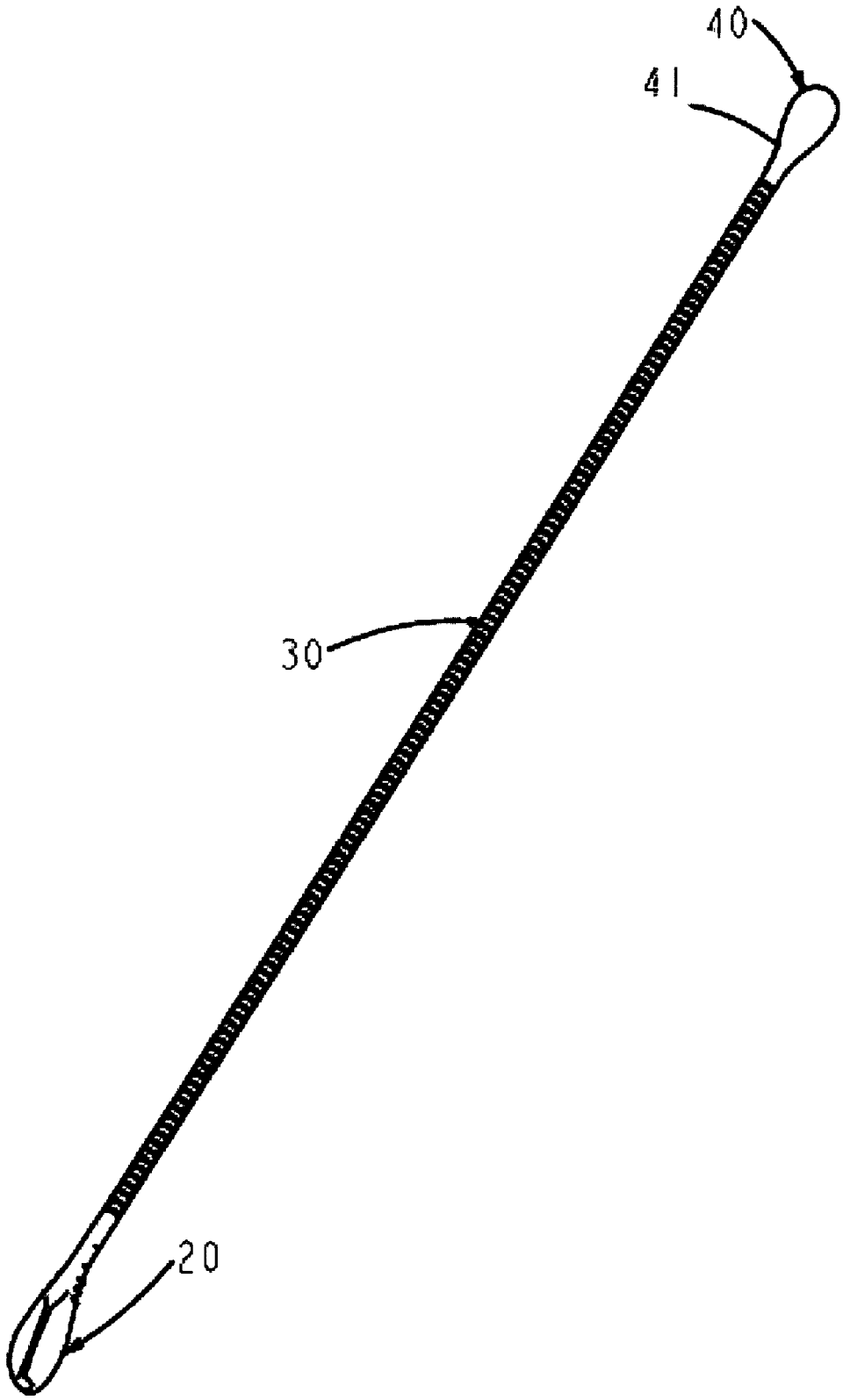
FIG. 1 is a perspective view of an adjustable bundling device according to a preferred embodiment of the present invention.

Referring now to FIG. 1, the present invention is comprised of cavity end 20, textured cord 30, stop 40, raised branding area 41.

Figure 2:
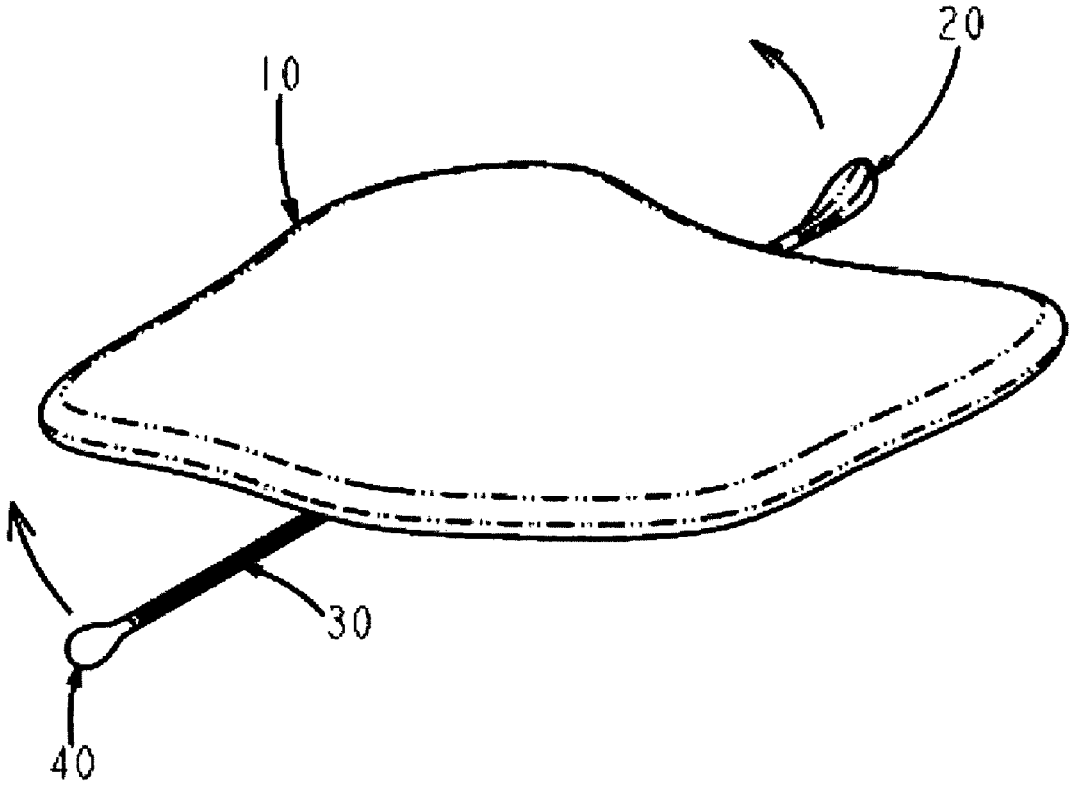
FIG. 2 is a perspective view of an adjustable bundling device showing the first step in clenching an item according to a preferred embodiment of the present invention.

Referring now to FIG. 2, object 10, cavity end 20, textured cord 30, and stop 40 are shown.

Figure 3:
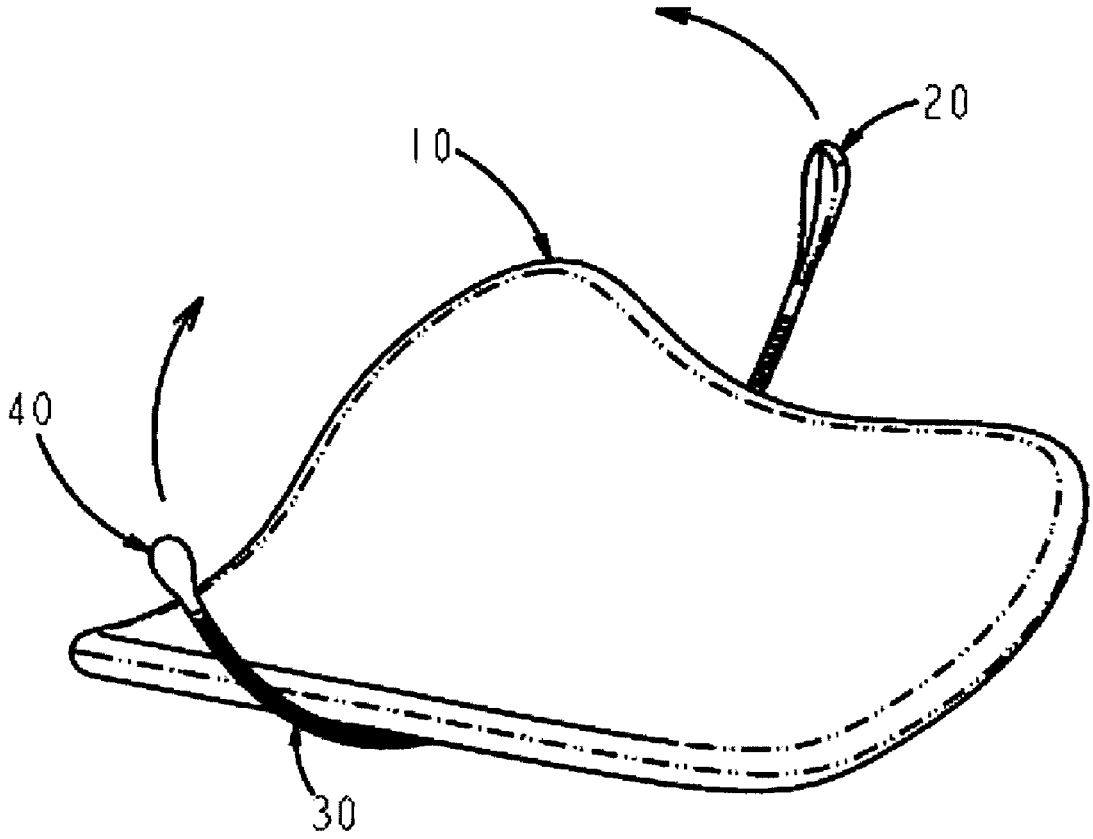
FIG. 3 is a perspective view of an adjustable bundling device showing an intermediate step of clenching a flexible item according to a preferred embodiment of the present invention.

Referring now to FIG. 3, object 10, cavity end 20, textured cord 30, and stop 40 are shown.

Figure 4:
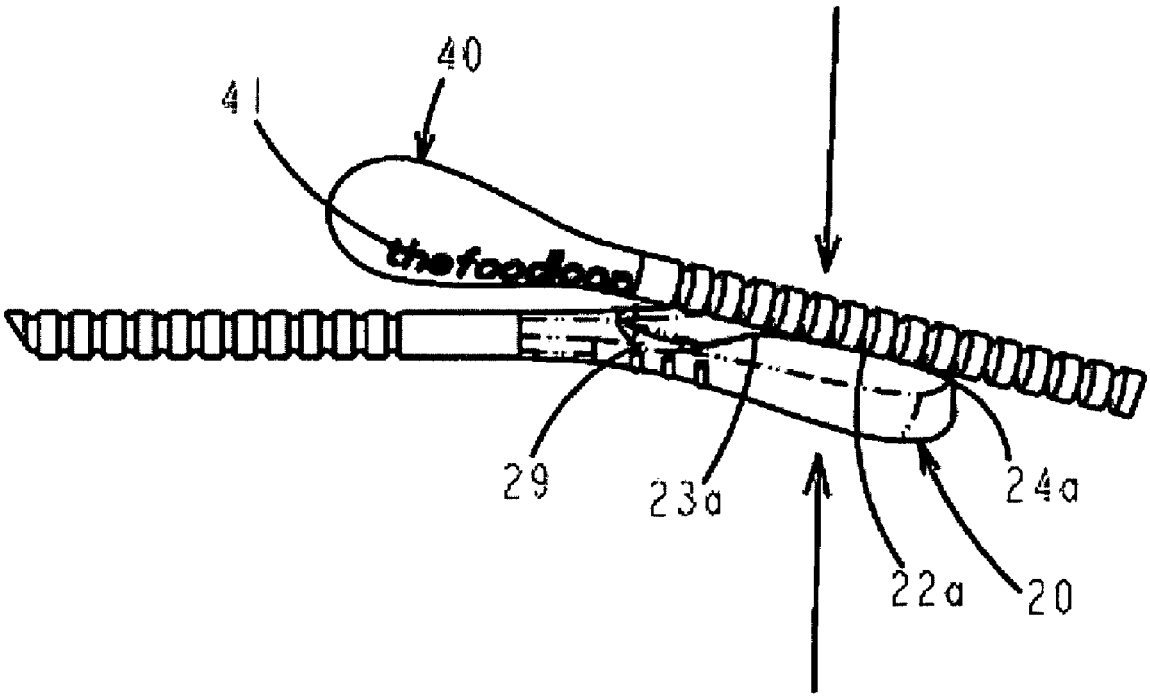
FIG. 4 is a detailed view of an adjustable bundling device showing how the cord portion is inserted into the locking cavity according to a preferred embodiment of the present invention.

Referring now to FIG. 4, cavity end 20, flexible edge-a 22*a*, back cord lock-a 23*a*, front cord lock-a 24*a*, back cord guide 29, stop 40, and raised branding area 41 are shown.

Figure 5:
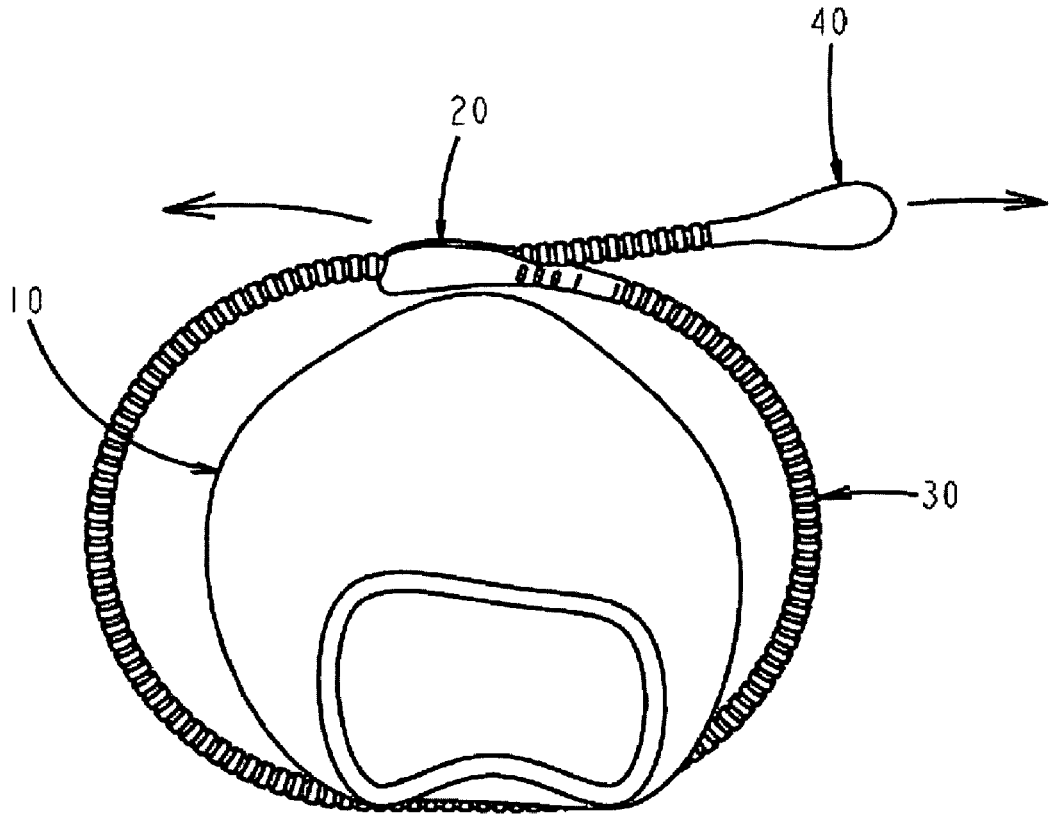
FIG. 5 is a side plan view of an adjustable bundling device showing how to tighten the loop portion and clench an object according to a preferred embodiment of the present invention.

Referring now to FIG. 5, object 10, cavity end 20, textured cord 30, and stop 40 are shown.

Figure 6:
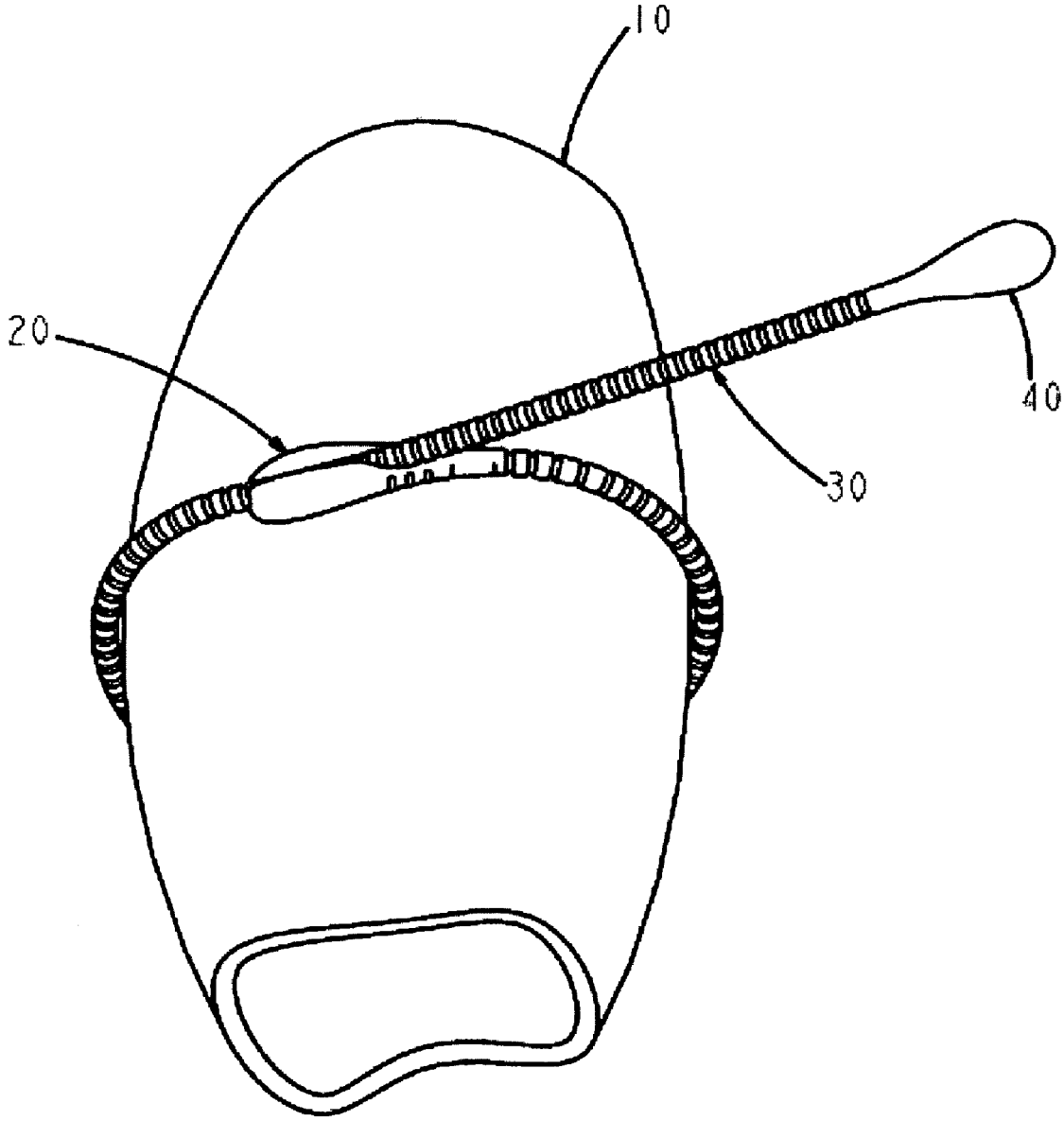
FIG. 6 is a perspective view of an adjustable bundling device showing the clenching of a flexible object according to a preferred embodiment of the present invention.

Referring now to FIG. 6, object 10, cavity end 20, textured cord 30, and stop 40 are shown.

Figure 7:
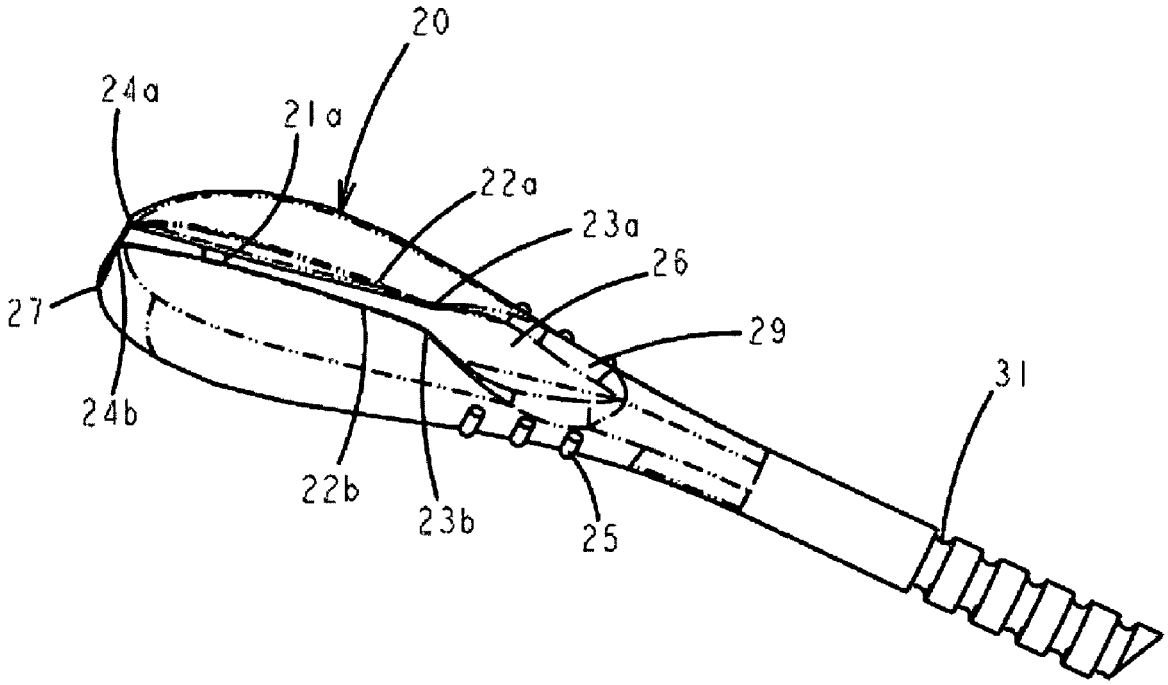
FIG. 7 is a detailed view of the locking cavity portion of an adjustable bundling device according to a preferred embodiment of the present invention.

Referring now to FIG. 7, cavity end 20, mating protrusion-a 21*a*, flexible edge-a 22*a*, flexible edge-b 22*b*, back cord lock-a 23*a*, back cord lock-b 23*b*, front cord lock-a 24*a*, front cord lock-b 24*b*, finger grip 25, interior cavity 26, front cord guide 27, back cord guide 29, and cord indentions 31 are shown.

Figure 8:
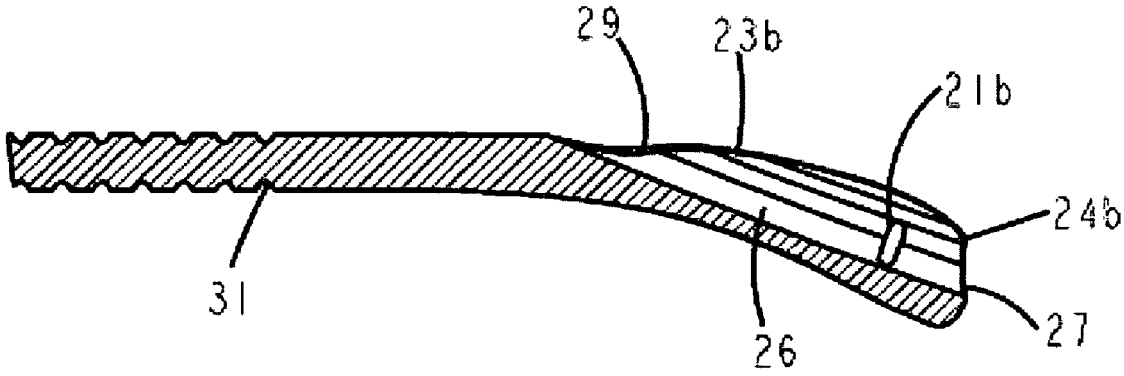
FIG. 8 detailed view showing a longitudinal section through the locking cavity portion according to a preferred embodiment of the present invention.

Referring now to FIG. 8, mating protrusion-b 21*b*, back cord lock-b 23*b*, front cord lock-b 24*b*, interior cavity 26, front cord guide 27, back cord guide 29, and cord indentions 31 are shown.

Figure 9:
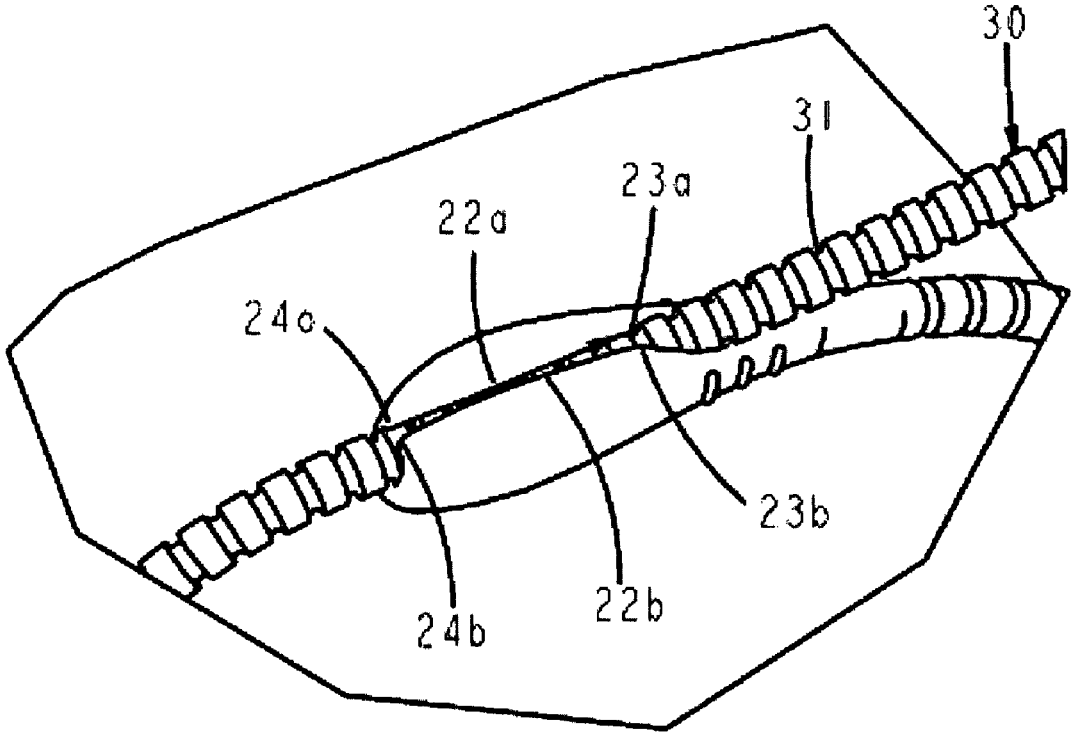
FIG. 9 is a partial view of the cord portion of an adjustable bundling device being held by the locking cavity portion of an adjustable bundling device according to a preferred embodiment of the present invention.

Referring now to FIG. 9, flexible edge-a 22*a*, flexible edge-b 22*b*, back cord lock-a 23*a*, back cord lock-b 23*b*, front cord lock-a 24*a*, front cord lock-b 24*b*, textured cord 30, and cord indentions 31 are shown.

Figure 10:
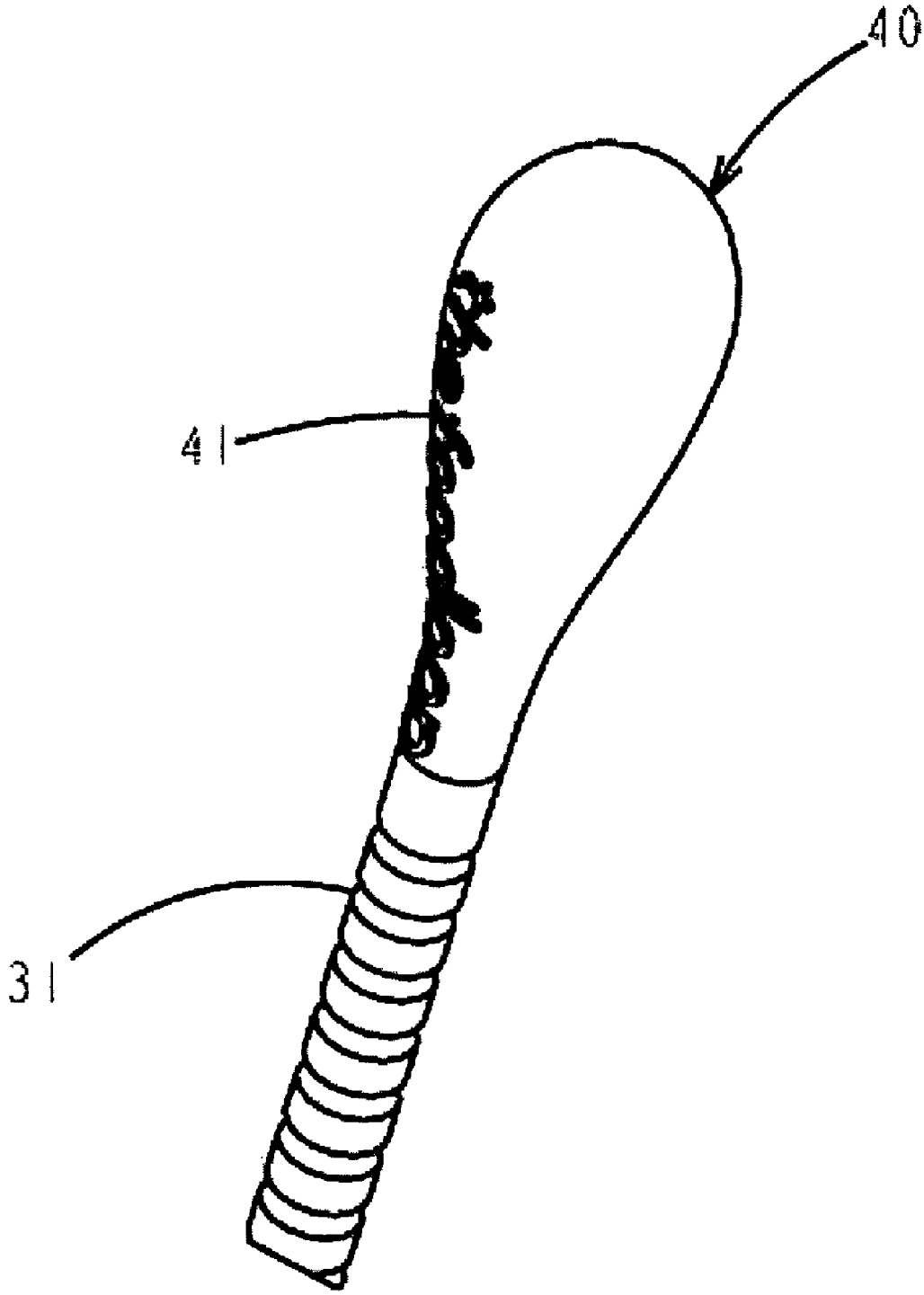
FIG. 10 is a partial view of the stop portion of an adjustable bundling device at the end of the cord portion of an adjustable bundling device according to a preferred embodiment of the present invention.

Referring now to FIG. 10, object 10, cord indentions 31, stop 40, and raised branding area 41 are shown.

Figure 11:
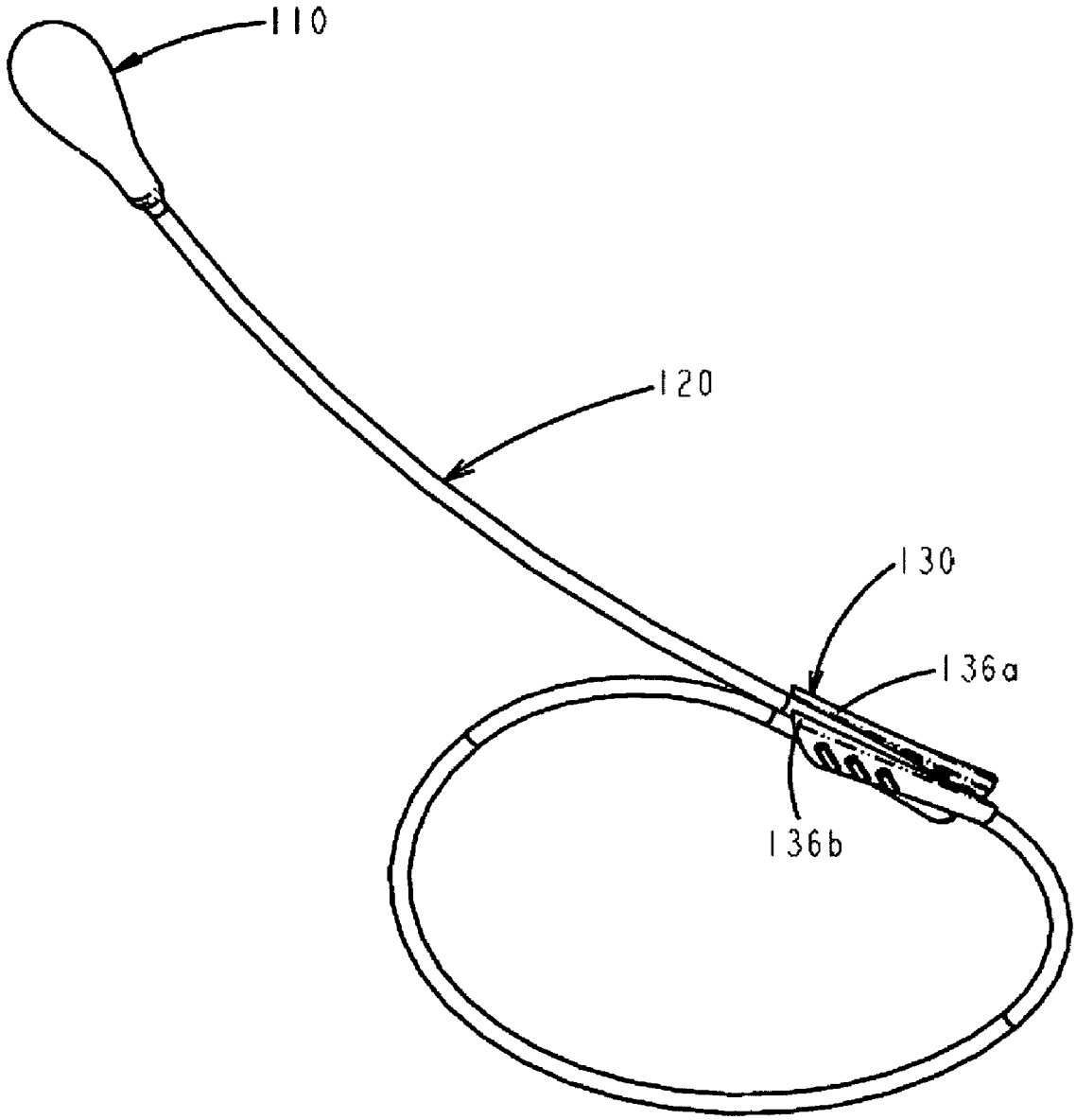
FIG. 11 is a top perspective view of an adjustable bundling device according to a second embodiment of the present invention.

Referring now to FIG. 11, stop end 110, textured cord 120, cavity end 130, lock lip-a 136*a*, and lock lip-b 136*b* are shown.

Figure 12:
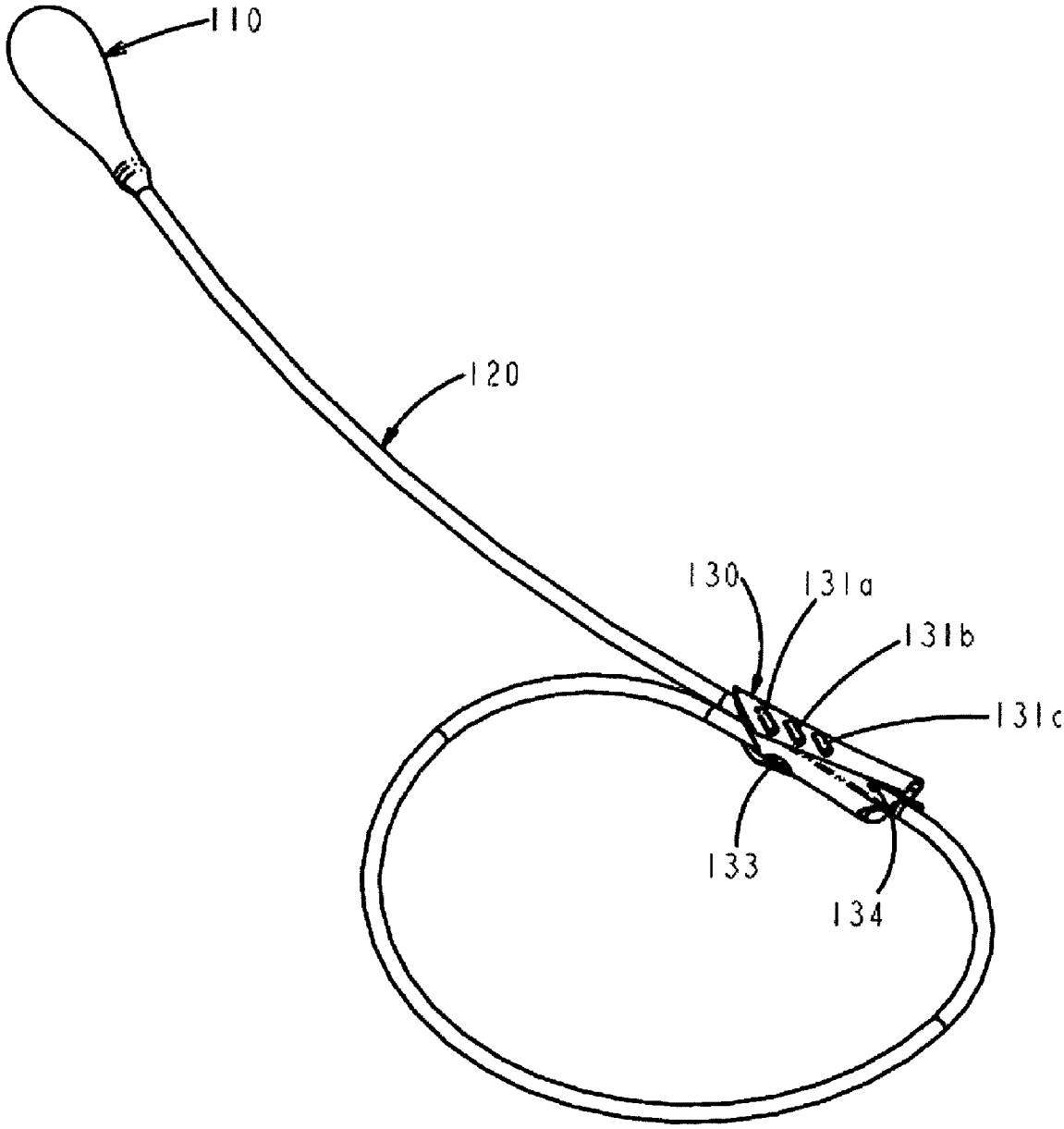
FIG. 12 is a bottom perspective view of an adjustable bundling device according to a second embodiment of the present invention.

Referring now to FIG. 12, stop end 110, textured cord 120, cavity end 130, finger grip-a 131*a*, finger grip-b 131*b*, finger grip-c 131*c*, bottom weld area 133, and spiral stop 134 are shown.

Figure 13:
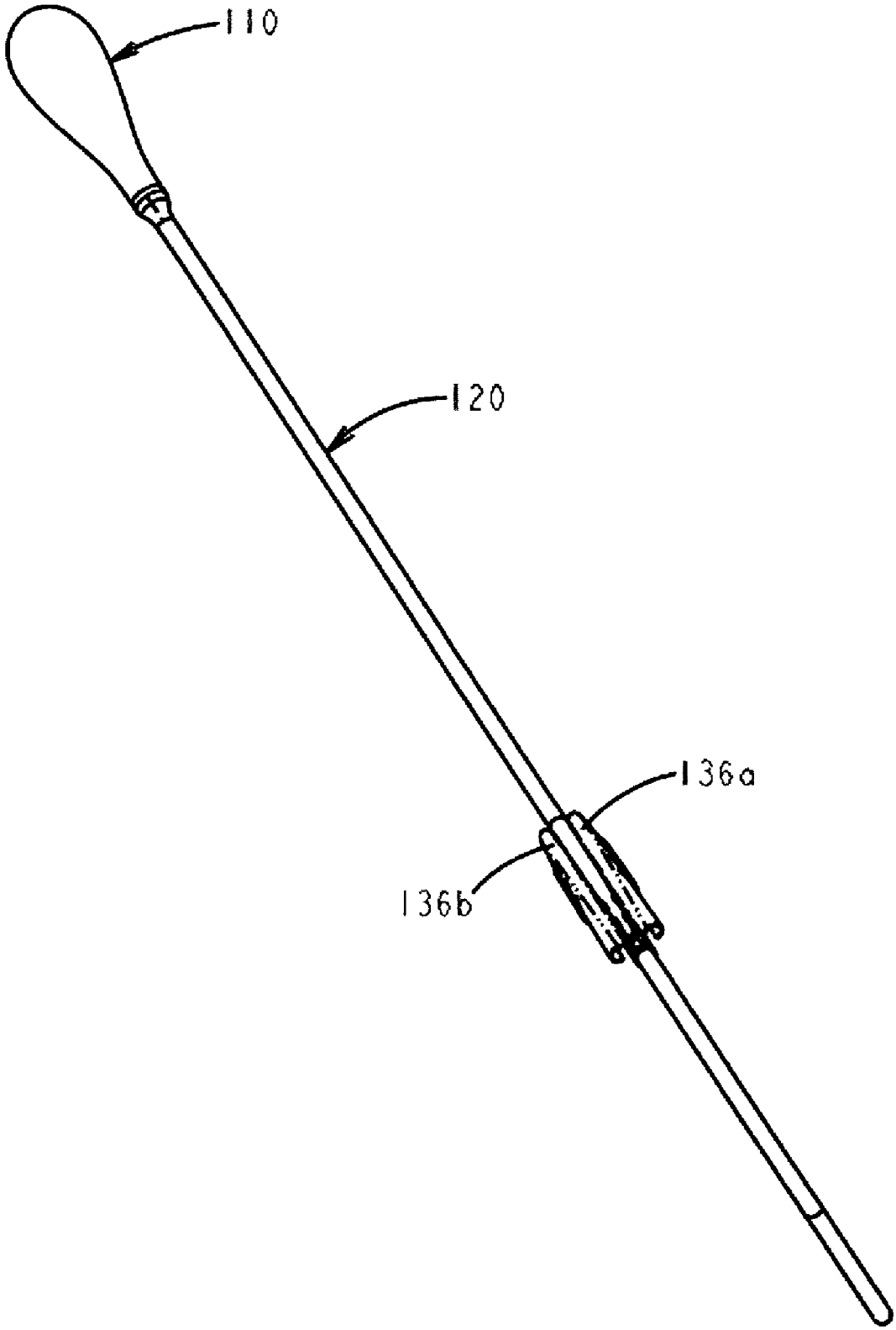
FIG. 13 is a top perspective view of an adjustable bundling device according to a second embodiment of the present invention.

Referring now to FIG. 13, stop end 110, textured cord 120, lock lip-a 136*a*, and lock lip-b 136*b* are shown.

Figure 14:
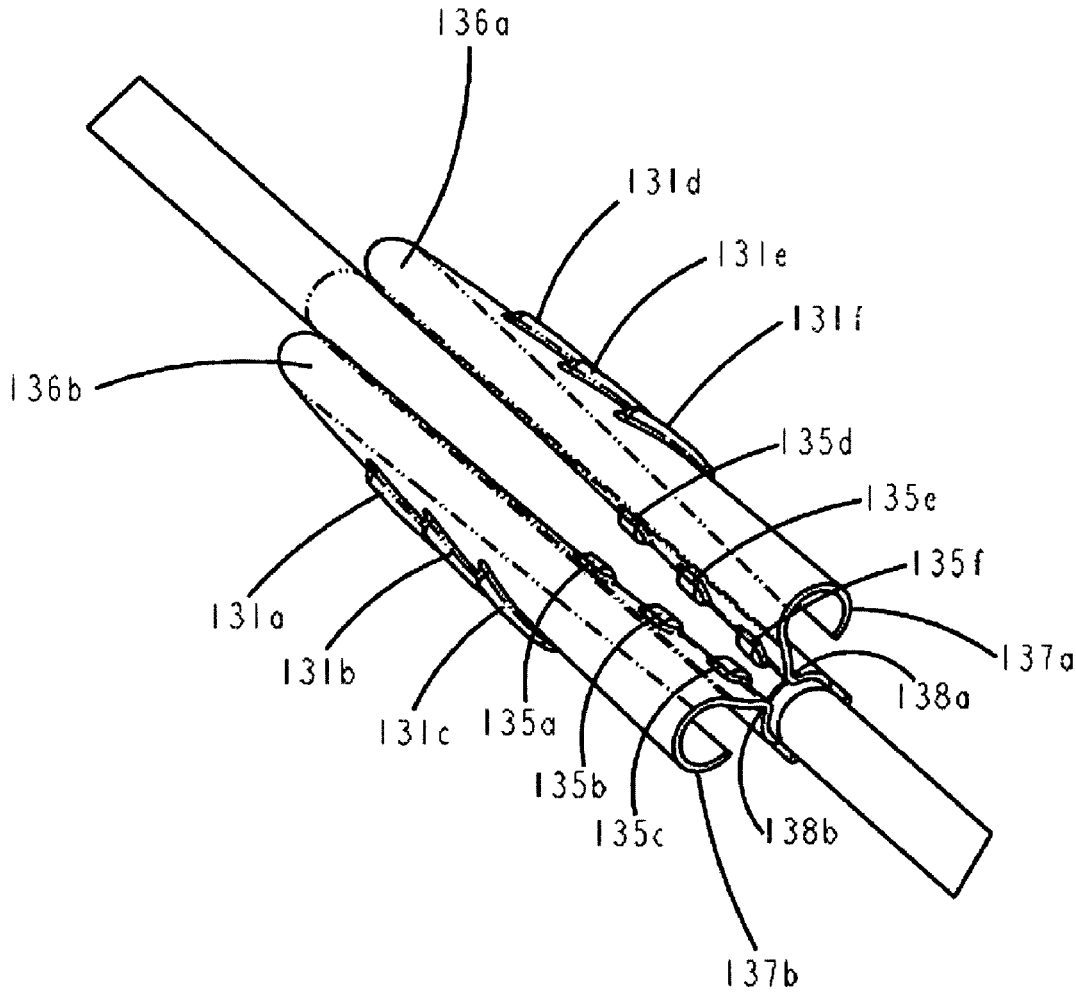
FIG. 14 is a partial view of the cord portion of an adjustable bundling device placed within the cavity portion of an adjustable bundling device according to a second embodiment of the present invention.

Referring now to FIG. 14, finger grip-a 131*a*, finger grip-b 131*b*, finger grip-c 131*c*, finger grip-d 131*d*, finger grip-e 131*e*, finger grip-f 131*f*, locking protrusion-a 135*a*, locking protrusion-b 135*b*, locking protrusion-c 135*c*, locking protrusion-d 135*d*, locking protrusion-e 135*e*, locking protrusion-f 135*f*, lock lip-a 136*a*, locking protrusion-b 135*b*, front wall-a 137*a*, front wall-b 137*b*, curve hinge-a 138*a*, and curve hinge-b 138*b* are shown.

Figure 15:
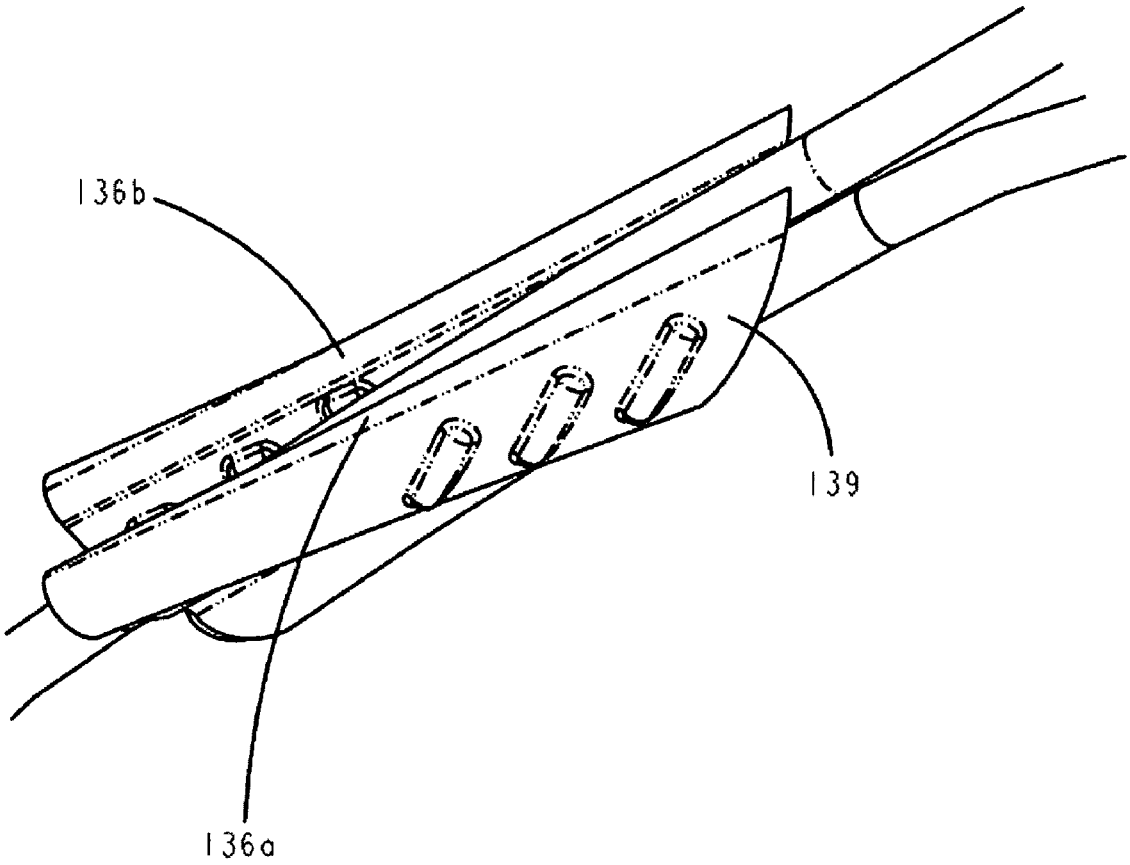
FIG. 15 is a partial view of the cavity finger grips of an adjustable bundling device according to a second embodiment of the present invention.

Referring now to FIG. 15, lock lip-a 136*a*, lock lip-b 136*b*, and outer wall 139 are shown.

Figure 16:
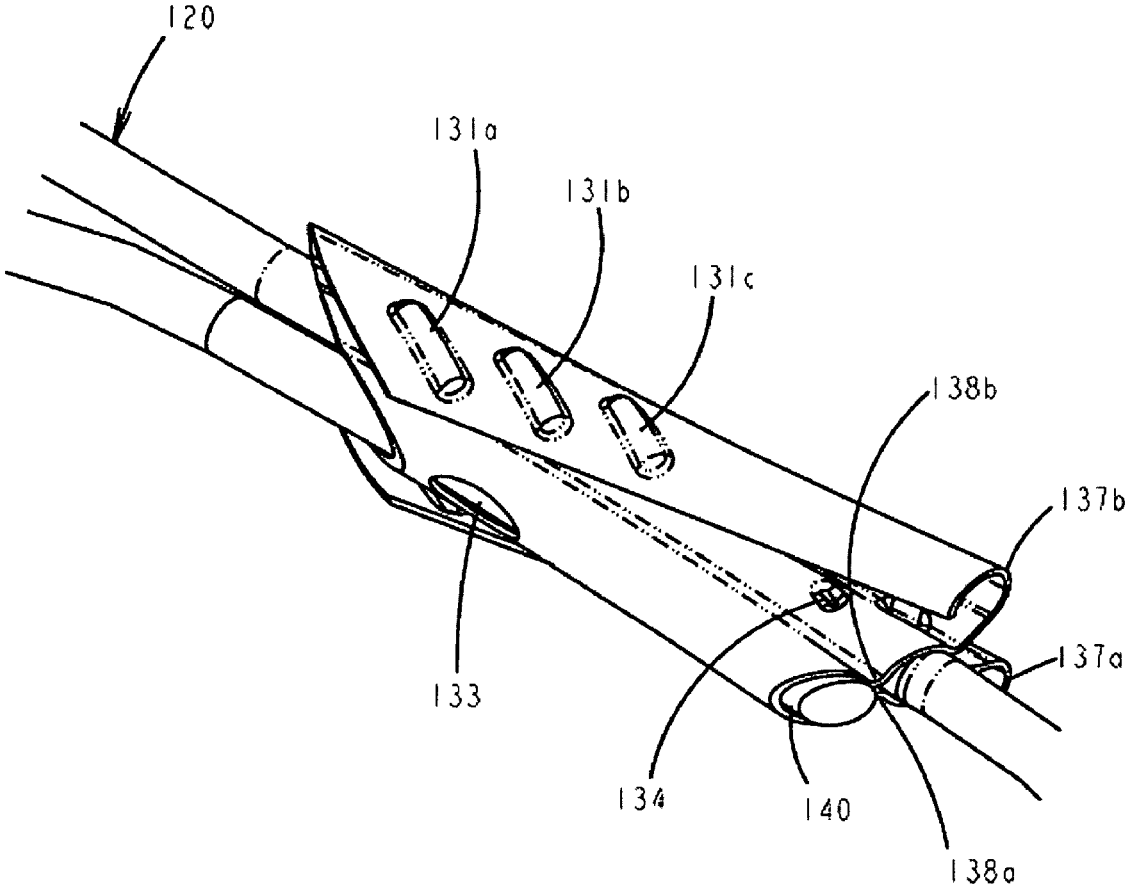
FIG. 16 is a partial view showing the underside of the cavity portion of an adjustable bundling device according to a second embodiment of the present invention.

Referring now to FIG. 16, textured cord 120, finger grip-a 131*a*, finger grip-b 131*b*, finger grip-c 131*c*, bottom weld area 133, spiral stop 134, front wall-a 137*a*, front wall-b 137*b*, curve hinge-a 138*a*, curve hinge-b 138*b*, and front weld area 140 are shown.

Figure 17:
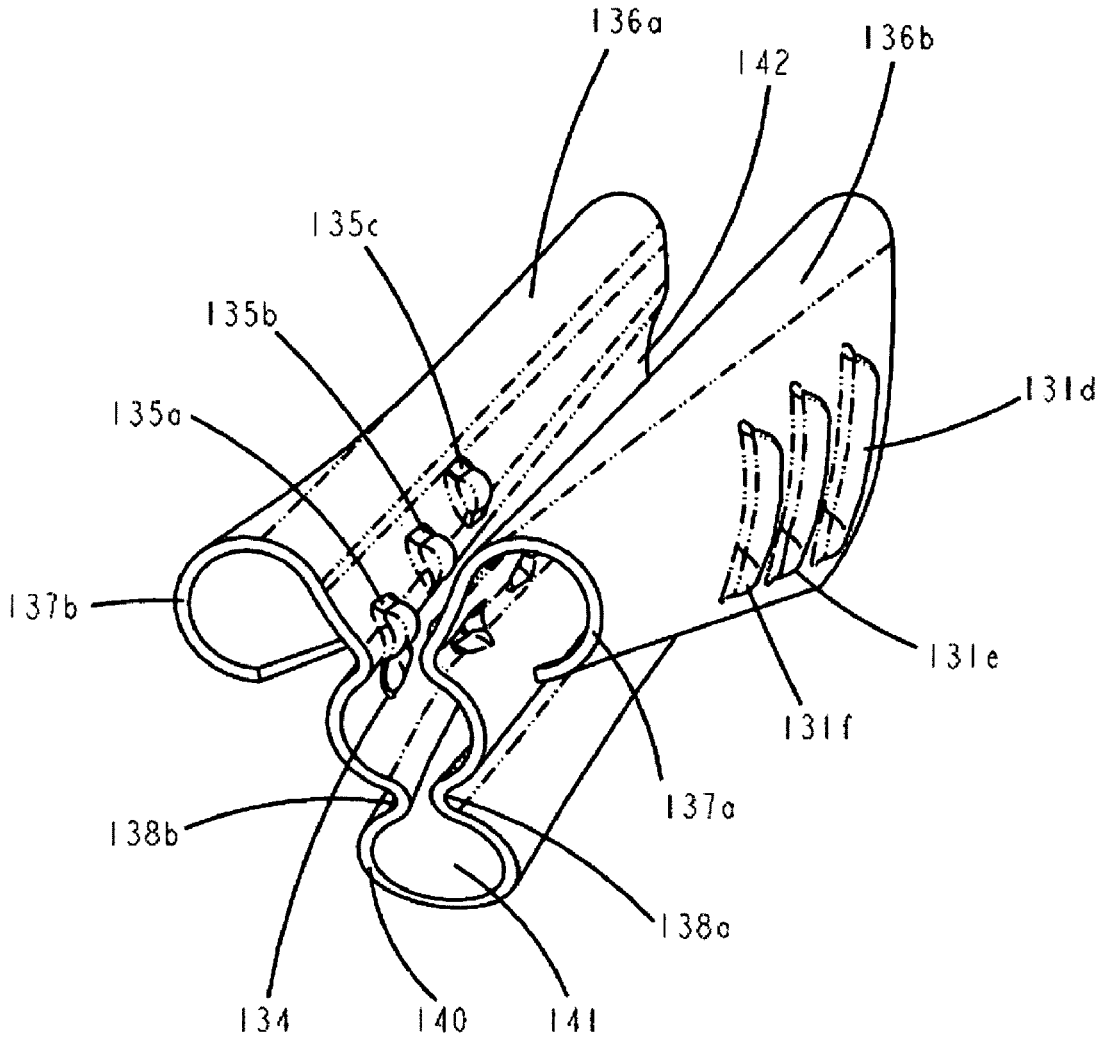
FIG. 17 is a partial view of the cavity portion of an adjustable bundling device without the cord portion of an adjustable bundling device inserted within the cavity portion according to a second embodiment of the present invention.

Referring now to FIG. 17, finger grip-d 131*d*, finger grip-e 131*e*, finger grip-f 131*f*, spiral stop 134, locking protrusion-a 135*a*, locking protrusion-b 135*b*, locking protrusion-c 135*c*, lock lip-a 136*a*, lock lip-b 136*b*, front wall-a 137*a*, front wall-b 137*b*, curve hinge-a 138*a*, curve hinge-b 138*b*, front weld area 140.

Figure 18:
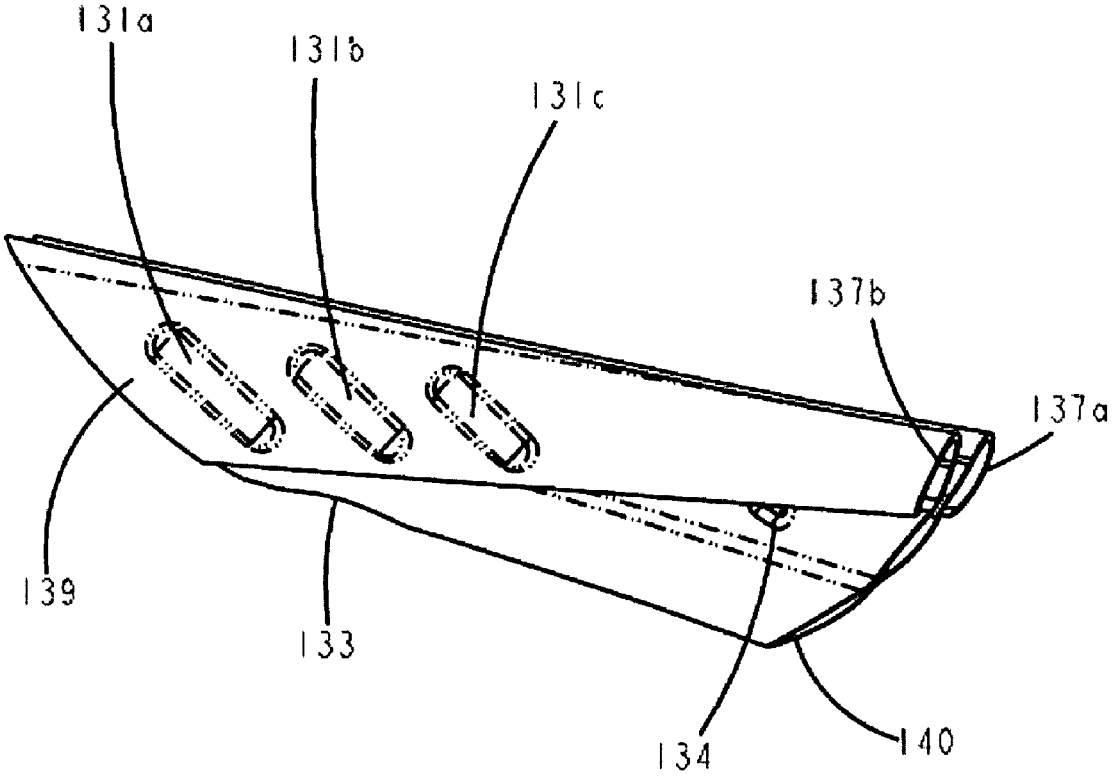
FIG. 18 is a partial view showing the side of the cavity portion of an adjustable bundling device without the cord portion of an adjustable bundling device inserted according to a second embodiment of the present invention.

Referring now to FIG. 18, finger grip-a 131*a*, finger grip-b 131*b*, finger grip-c 131*c*, bottom weld area 133, spiral stop 134, front wall-a 137*a*, front wall-b 137*b*, outer wall 139, front weld area 140, bottom cord area 141, and inner cavity 142 are shown.

Figure 19:
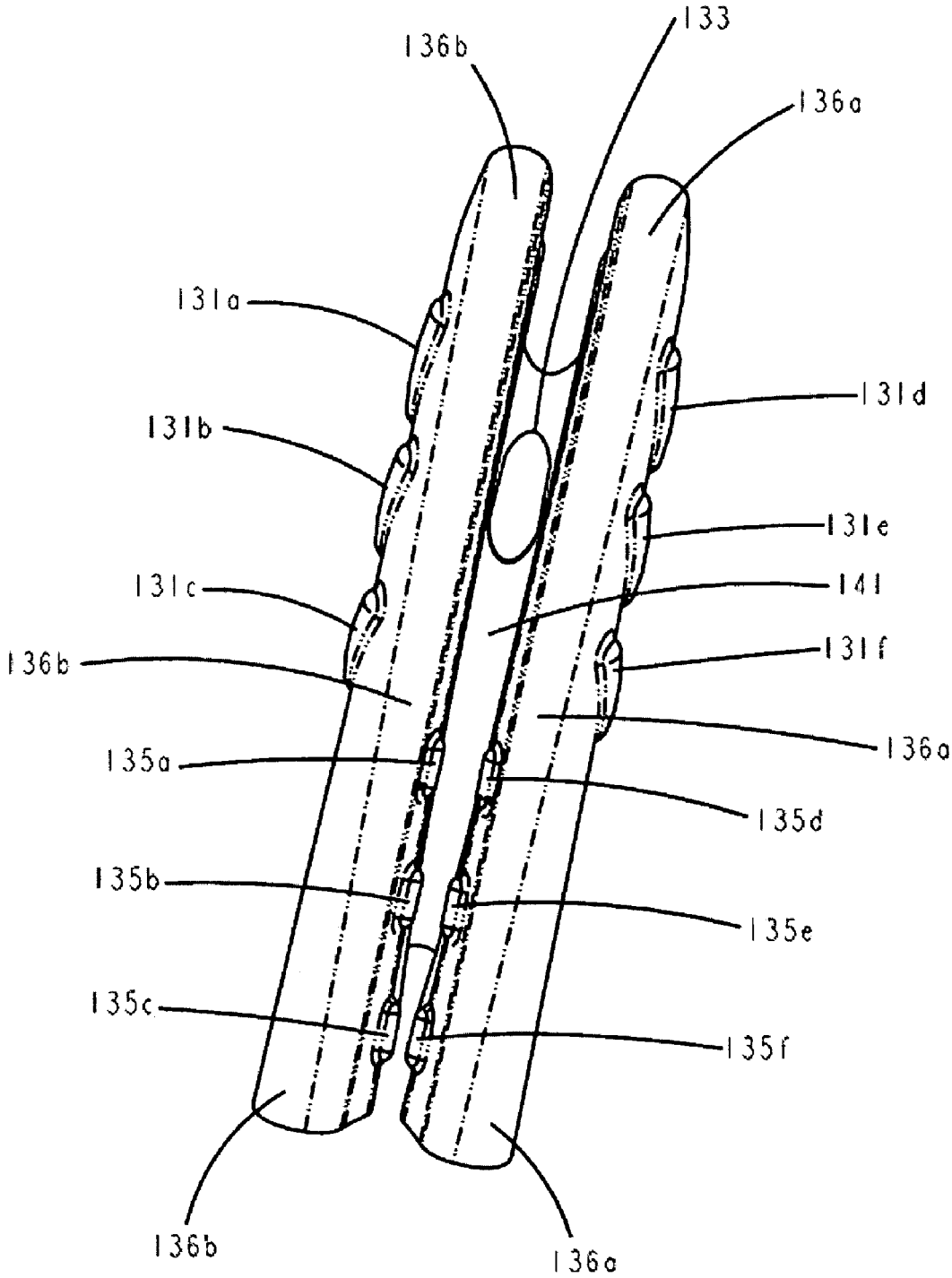
FIG. 19 is a partial view showing the front of the cavity portion of an adjustable bundling device without the cord portion inserted according to a second embodiment of the present invention.

Referring now to FIG. 19, finger grip-a 131*a*, finger grip-b 131*b*, finger grip-c 131*c*, finger grip-d 131*d*, finger grip-e 131*e*, finger grip-f 131*f*, bottom weld area 133, locking protrusion-a 135*a*, locking protrusion-b 135*b*, locking protrusion-c 135*c*, locking protrusion-d 135*d*, locking protrusion-e 135*e*, locking protrusion-f 135*f*, lock lip-a 136*a*, lock lip-b 136*b*, and bottom cord area 141 are shown.

Figure 20:
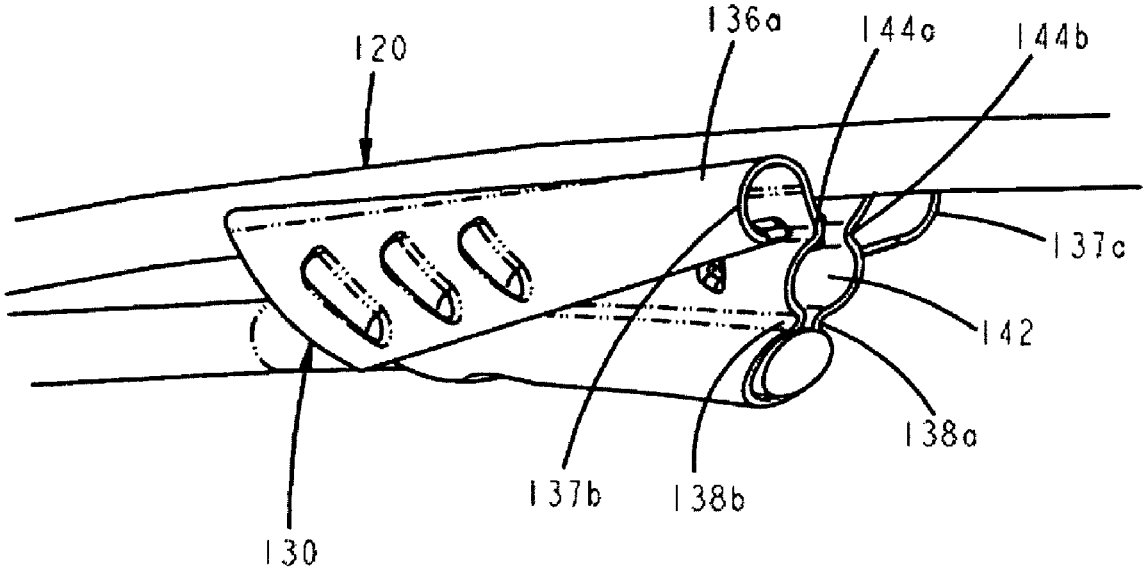
FIG. 20 is a partial view showing the cord portion of an adjustable bundling device ready for insertion into the cavity portion of an adjustable bundling device according to a second embodiment of the present invention.

Referring now to FIG. 20, textured cord 120, cavity end 130, lock lip-a 136*a*, front wall-a 137*a*, front wall-b 137*b*, curve hinge-a 138*a*, curve hinge-b 138*b*, inner cavity 142, front upper hinge-a 144*a*, front upper hinge-b 144*b* are shown.

Figure 21:
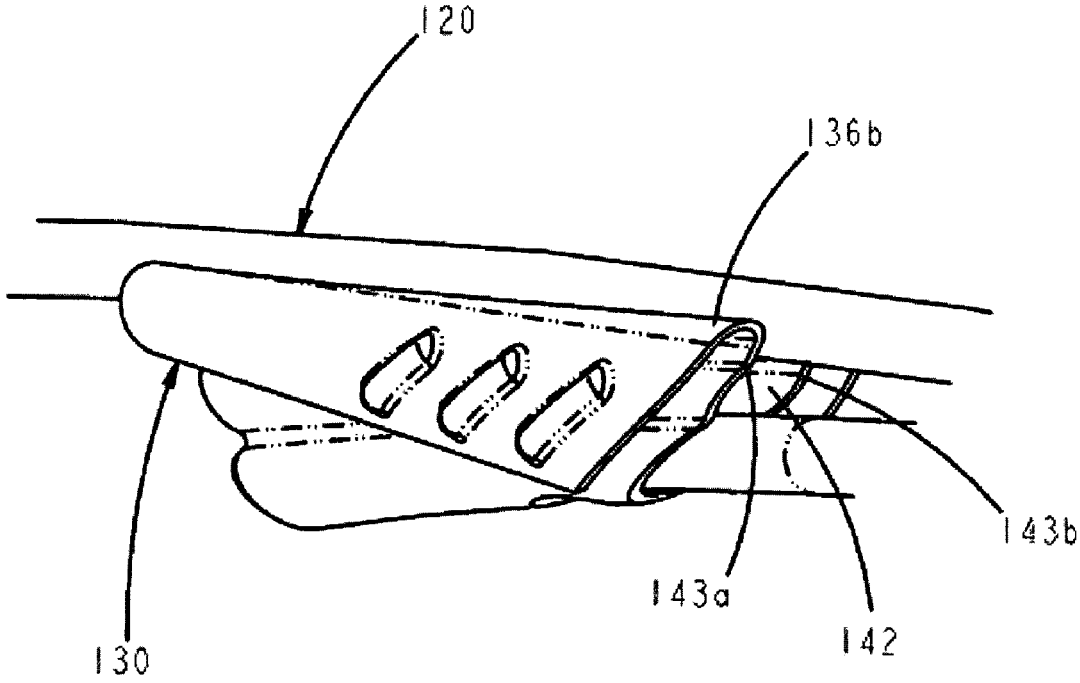
FIG. 21 is a partial view showing the cord portion of an adjustable bundling device ready for insertion into the cavity portion of an adjustable bundling device according to a second embodiment of the present invention.

Referring now to FIG. 21, textured cord 120, cavity end 130, lock lip-b 136*b*, inner cavity 142, back upper hinge-a 143*a*, and back upper hinge-b 143*b* are shown.

Figure 22:
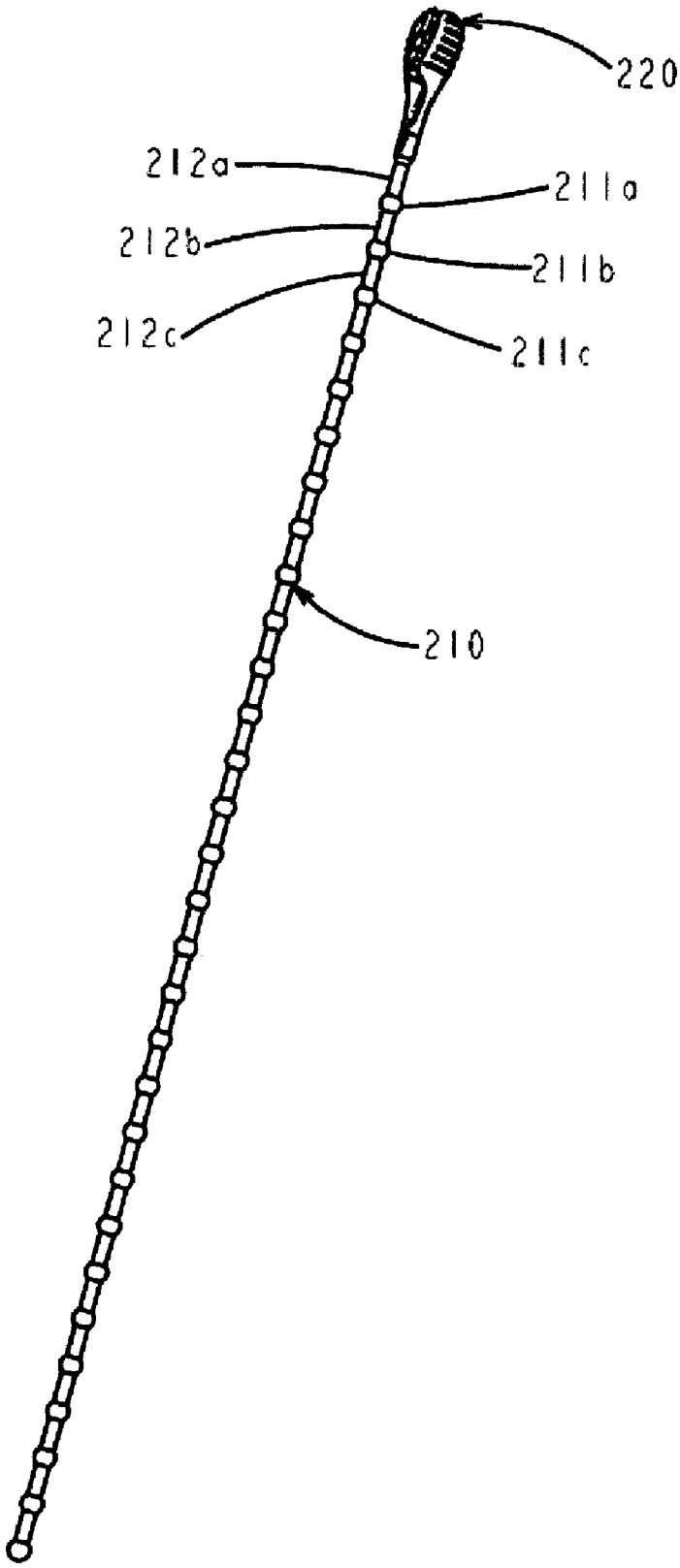
FIG. 22 is a perspective view of an adjustable bundling device according to a third embodiment of the present invention.

Referring now to FIG. 22, cord 210, spherical protrusion-a 211*a*, spherical protrusion-b 211*b*, spherical protrusion-c 211*c*, short cylinder-a 212*a*, short cylinder-b 212*b*, short cylinder-c 212*c*, and cavity end 220 are shown.

Figure 23:
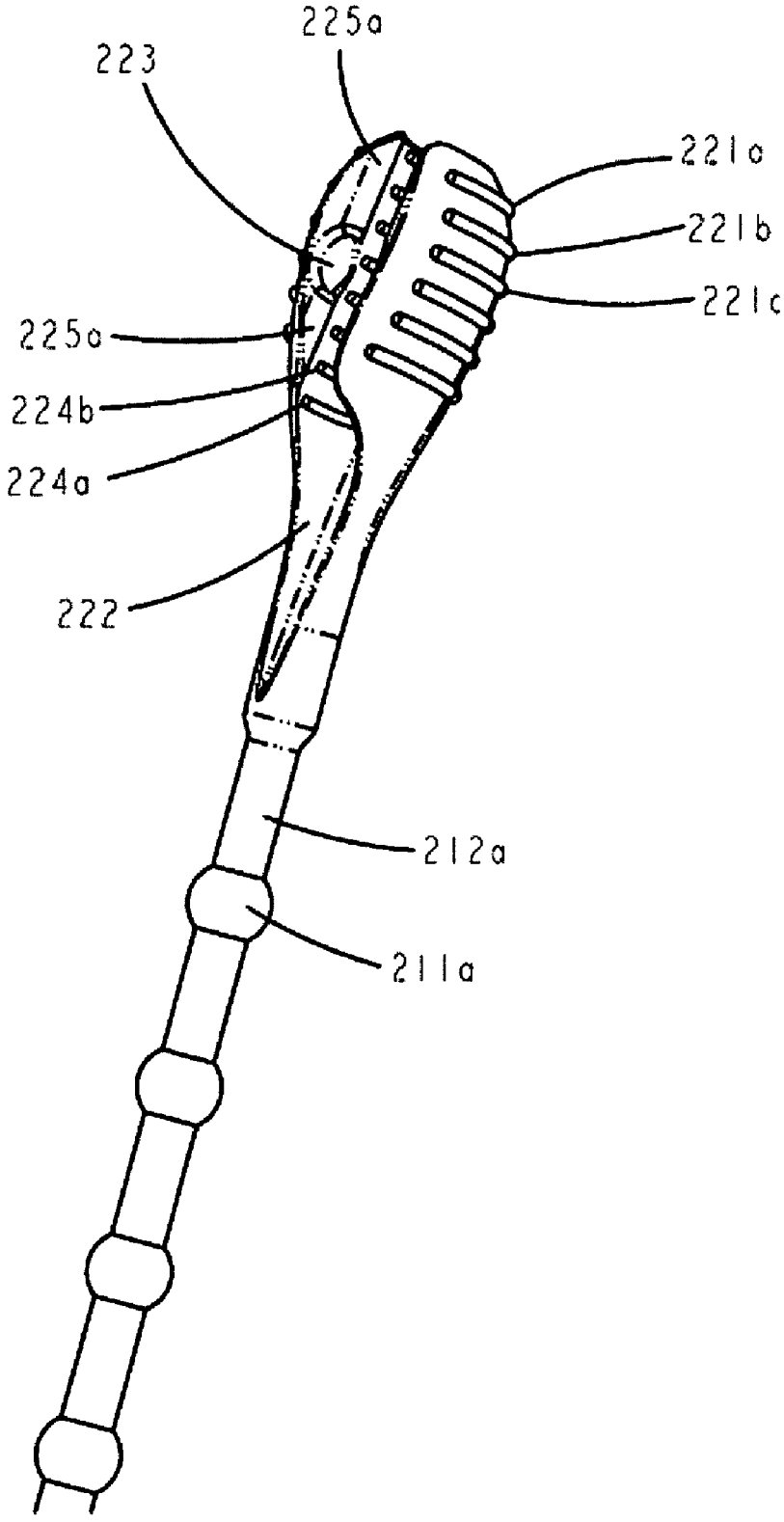
FIG. 23 is a partial view of the locking cavity portion of an adjustable bundling device according to a third embodiment of the present invention.

Referring now to FIG. 23, spherical protrusion-a 211*a*, short cylinder-a 212*a*, finger grip outside protrusion-a 221*a*, finger grip outside protrusion-b 221*b*, finger grip outside protrusion-c 221*c*, inner cavity 222, spherical cut 223, inner protrusion-a 224*a*, inner protrusion-b 224*b*, and cavity lip-a 225*a* are shown.

Figure 24:
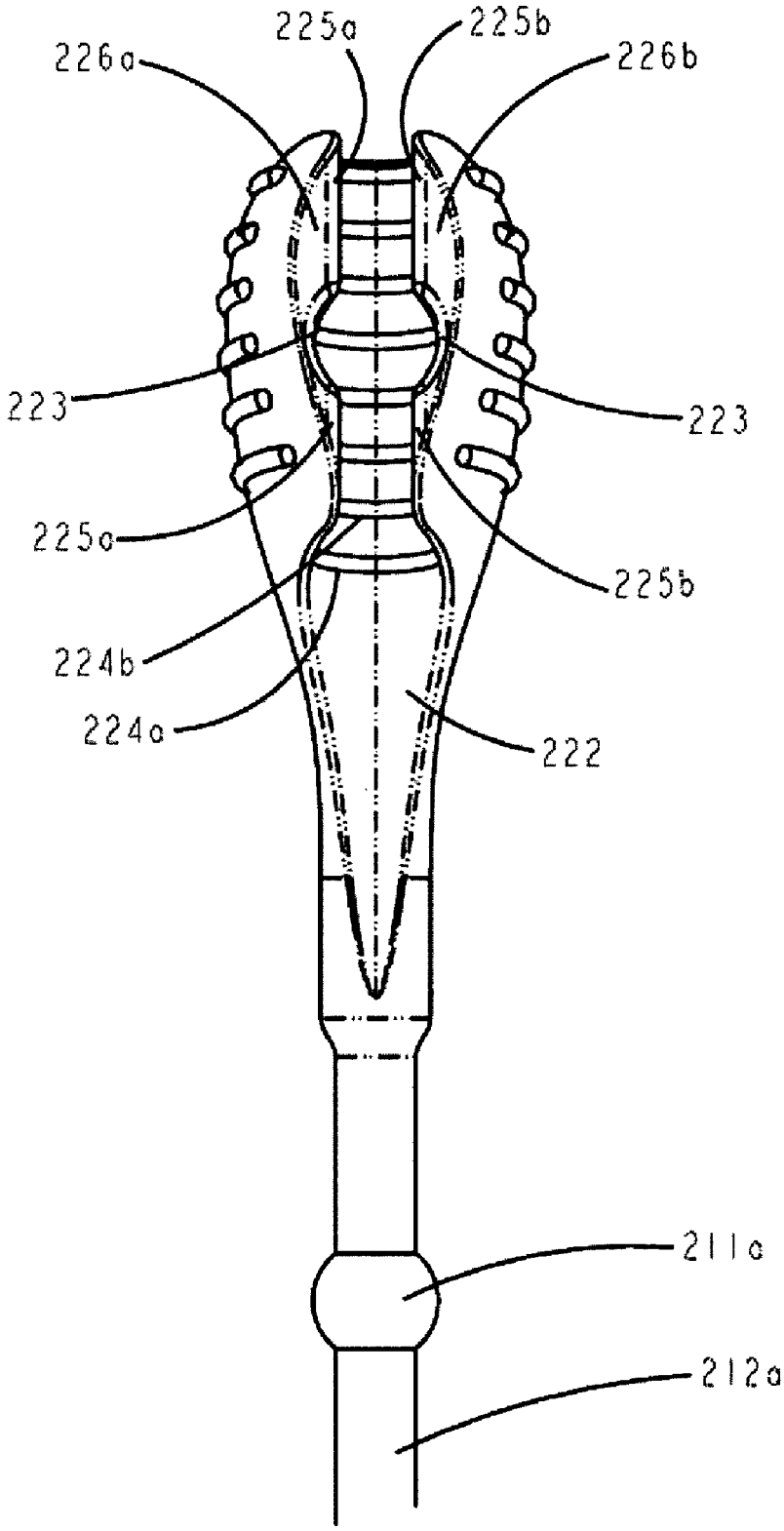
FIG. 24 is a partial view of the locking cavity portion of an adjustable bundling device according to a third embodiment of the present invention.

Referring now to FIG. 24, spherical protrusion-a 211*a*, short cylinder-a 212*a*, inner cavity 222, spherical cut 223, cavity lip-a 225*a*, inner protrusion-b 224*b*, cavity lip-a 225*a*, cavity lip-b 225*b*, sloped lip section-a 226*a*, and sloped lip section-b 226*b* are shown.

Figure 25:
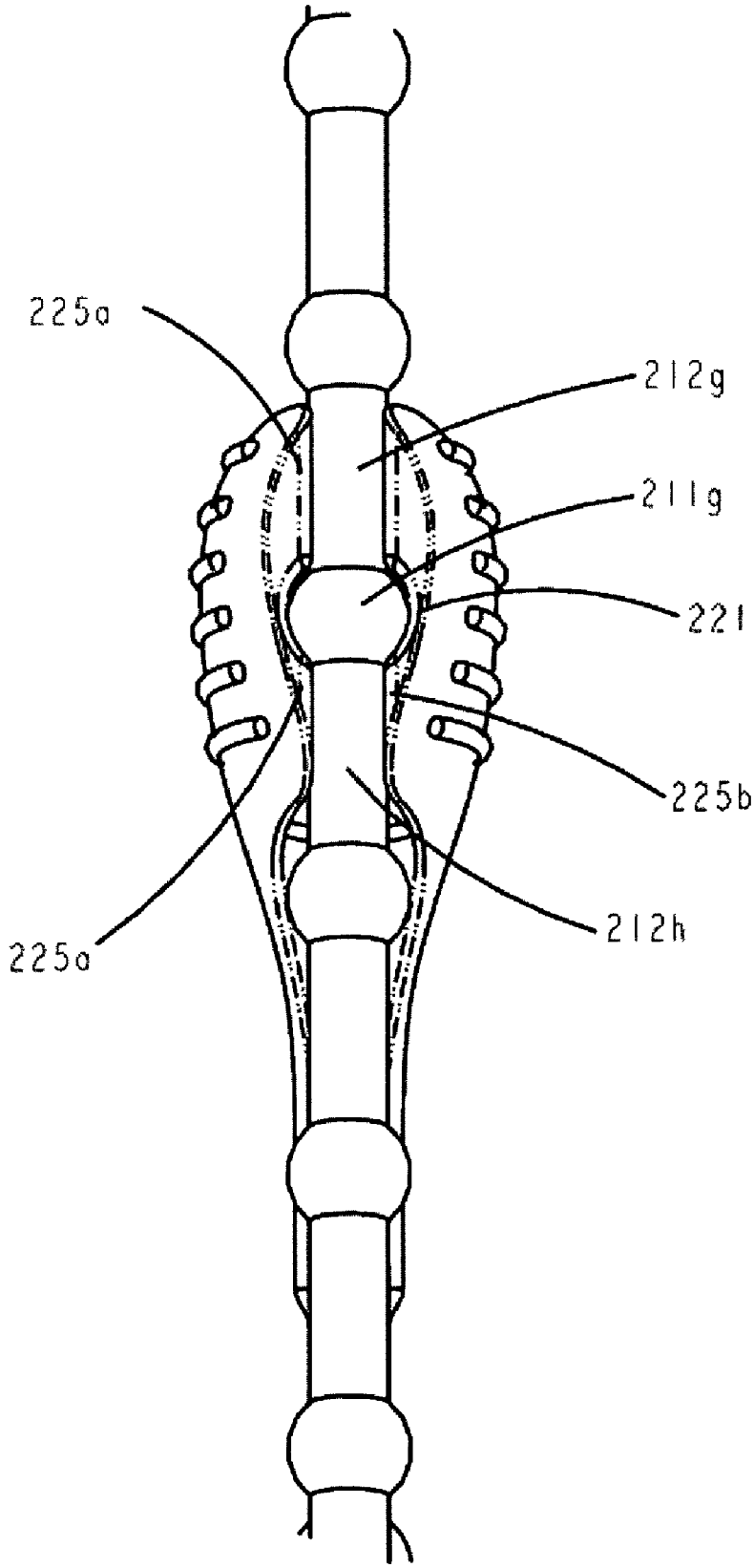
FIG. 25 is a partial view showing the cord portion of an adjustable bundling device in the locked position in the cavity portion of an adjustable bundling device according to a third embodiment of the present invention.

Referring now to FIG. 25, spherical protrusion-g 211*g*, short cylinder-g 212*g*, short cylinder-h 212*h*, finger grip outside protrusion 221, cavity lip-a 225*a*, and cavity lip-b 225*b* are shown.

Figure 26:
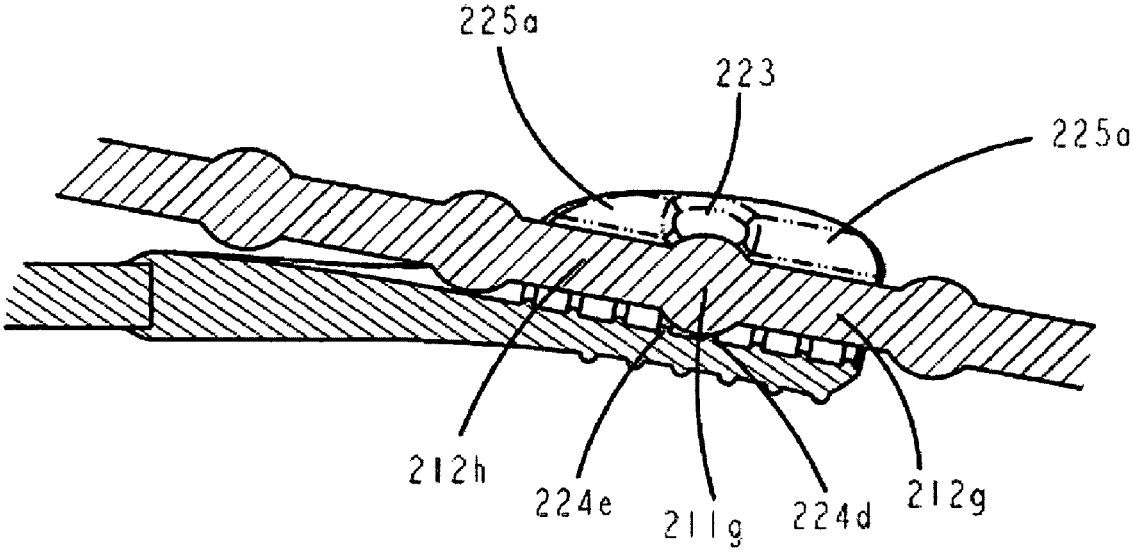
FIG. 26 is a partial view showing a longitudinal section of the locking cavity portion of an adjustable bundling device with the cord portion of an adjustable bundling device in the locked position within the locking cavity portion according to a third embodiment of the present invention.

Referring now to FIG. 26, spherical protrusion-g 211*g*, short cylinder-g 212*g*, short cylinder-h 212*h*, finger grip outside protrusion 221, inner protrusion-d 224*d*, inner protrusion-e 224*e*, and cavity lip-a 225*a* are shown.

Figure 27:
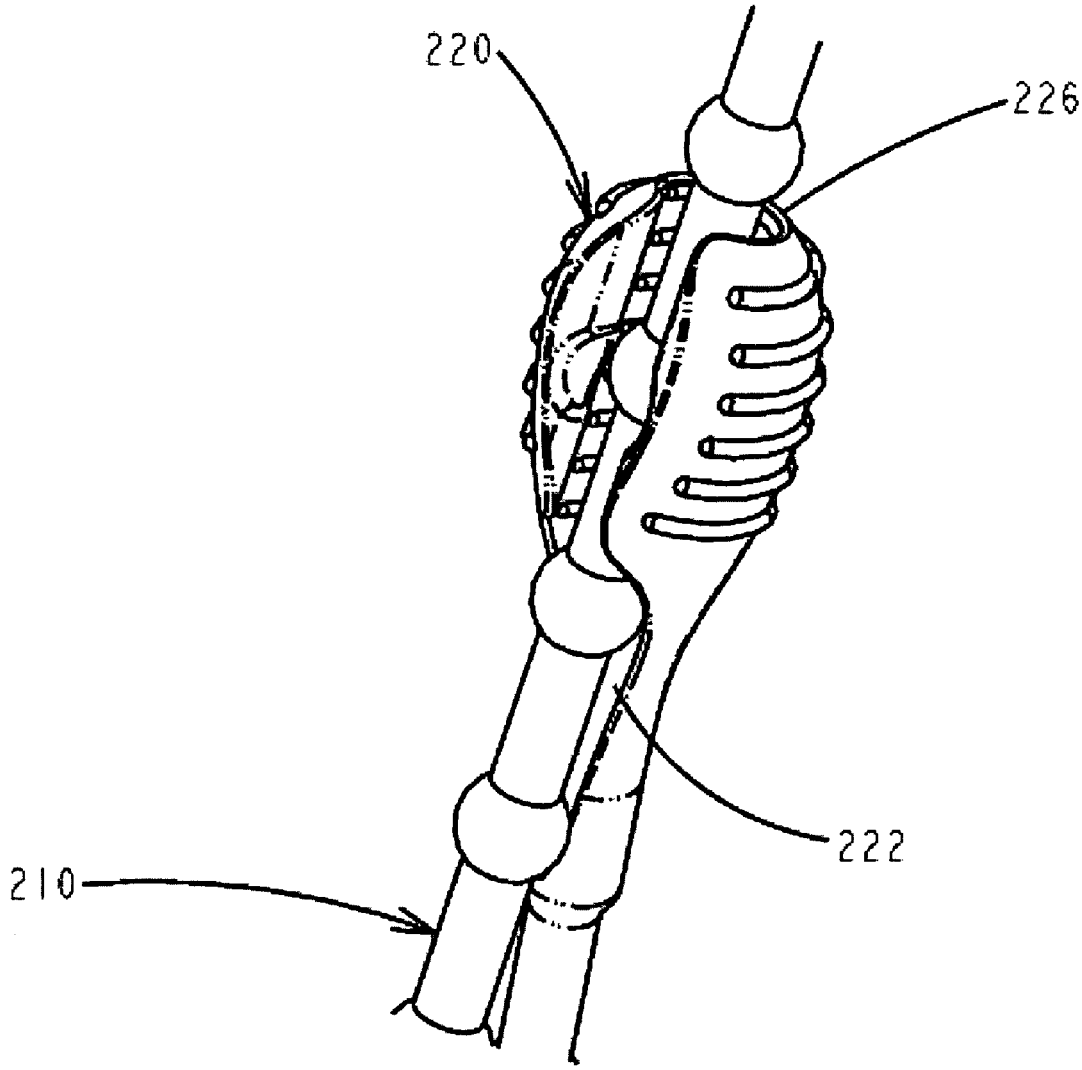
FIG. 27 is a partial view showing the locking cavity portion an adjustable bundling device with the cord portion in the locked position within the locking cavity portion according to a third embodiment of the present invention.

Referring now to FIG. 27, cord 210, cavity end 220, inner cavity 222, and sloped lip section 226 are shown.

Figure 28:
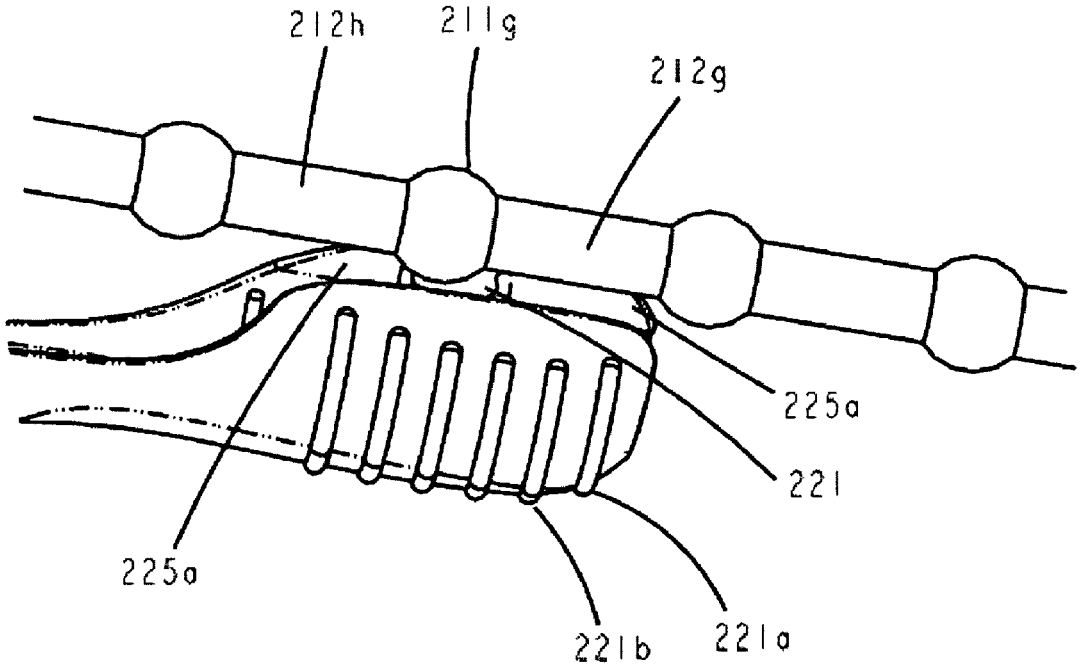
FIG. 28 is a partial view showing the cord portion of an adjustable bundling device in the ready to lock position according to a third embodiment of the present invention.

Referring now to FIG. 28, spherical protrusion-g 211*g*, short cylinder-g 212*g*, short cylinder-h 212*h*, finger grip outside protrusions 221, finger grip outside protrusion-a 221*a*, finger grip outside protrusion-b 221*b*, finger grip outside protrusion-a 221*a*, and cavity lip-a 225*a* are shown.

Figure 29:
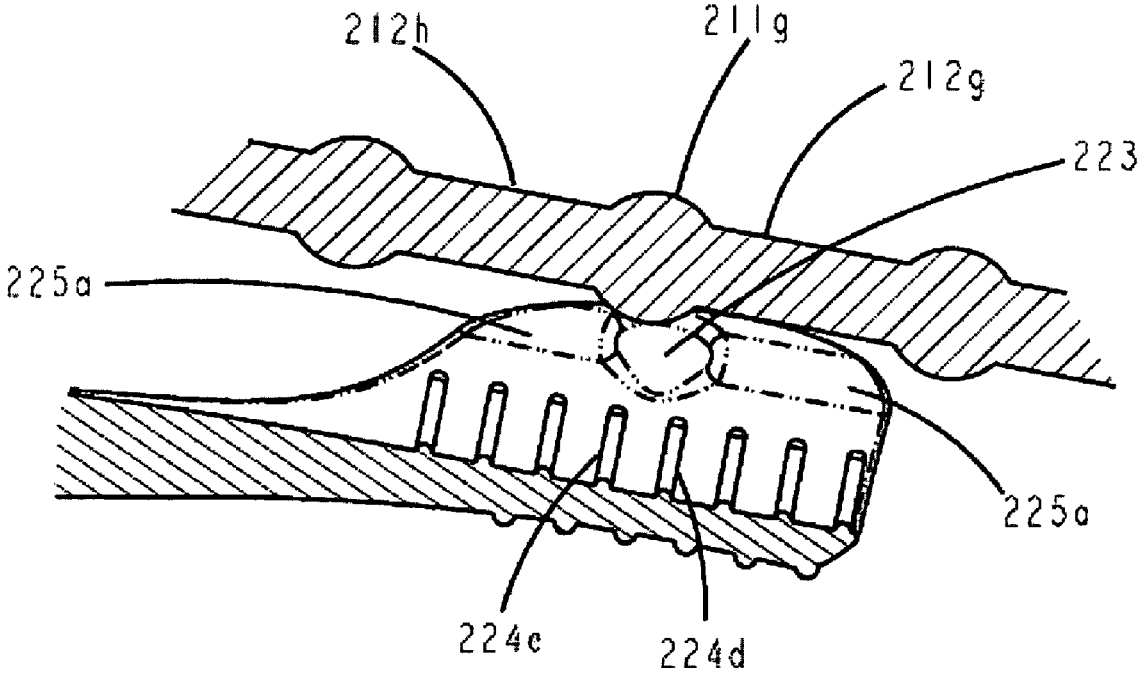
FIG. 29 is a partial view showing a longitudinal section of the cord portion of an adjustable bundling device in the ready to lock position according to a third embodiment of the present invention.

Referring now to FIG. 29, spherical protrusion-g 211*g*, finger grip outside protrusion 221, short cylinder-g 212*g*, short cylinder-h 212*h*, inner protrusion-d 224*d*, inner protrusion-e 224*e*, and cavity lip-a 225*a* are shown.

Figure 30:
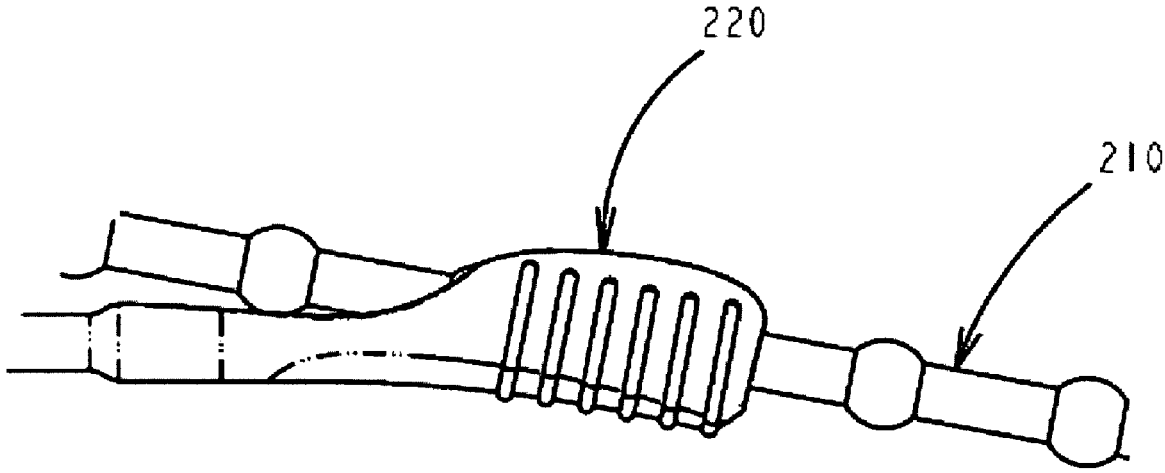
FIG. 30 is a partial view showing the cord portion of an adjustable bundling device in the locked position according to a third embodiment of the present invention.

Referring now to FIG. 30, cord 210, and cavity end 220 are shown.

Figure 31:
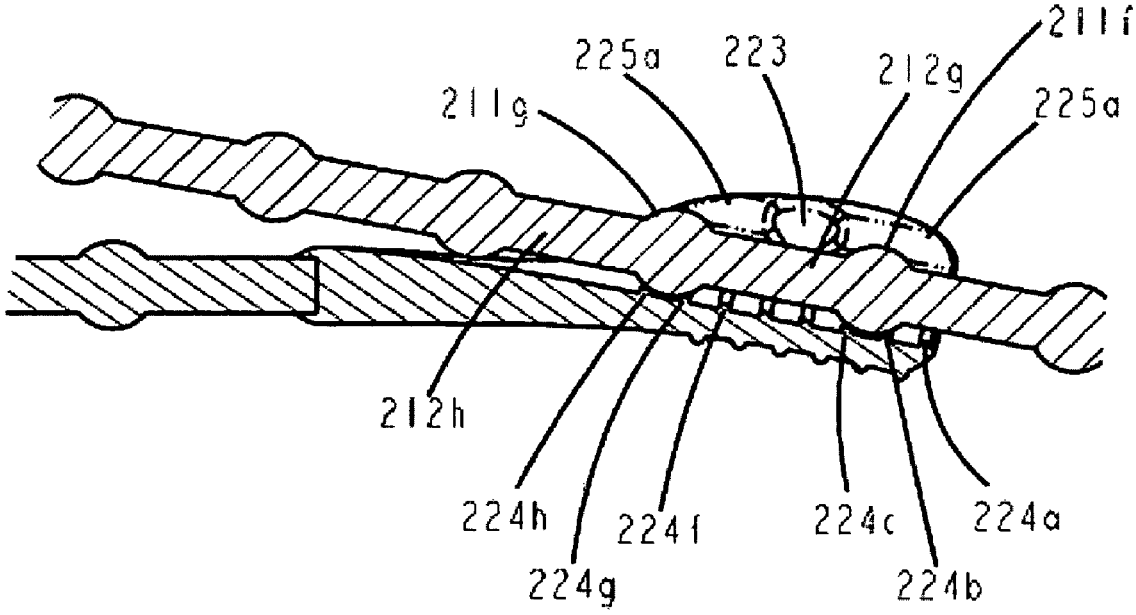
FIG. 31 is a partial view showing a longitudinal section of the cord portion of an adjustable bundling device in the locked position according to a third embodiment of the present invention.

Referring now to FIG. 31, spherical protrusion-f 211*f*, spherical protrusion-g 211*g*, short cylinder-g 212*g*, short cylinder-h 212*h*, inner protrusion-a 224*a*, spherical cut 223, inner protrusion-b 224*b*, inner protrusion-c 224*c*, inner protrusion-f 224*f*, inner protrusion-g 224*g*, inner protrusion-h 224*h*, and cavity lip-a 225*a* are shown.

Figure 32:
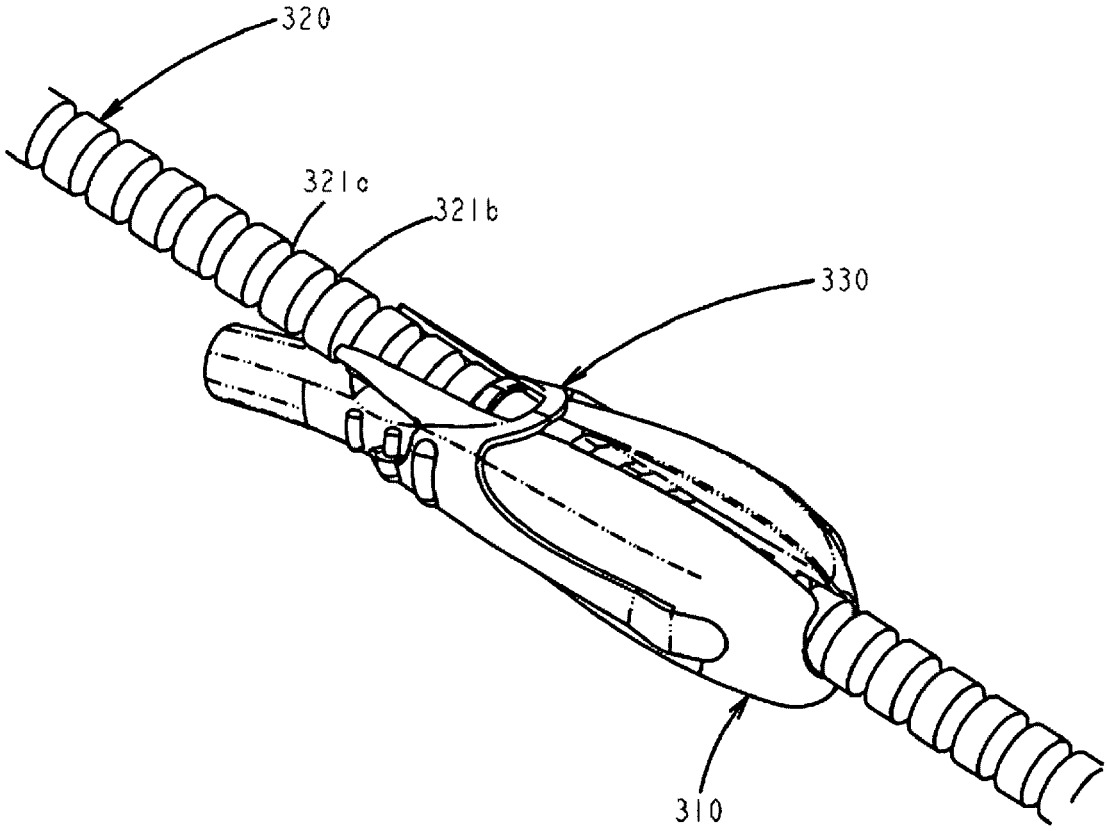
FIG. 32 is a partial view of an adjustable bundling device in the locked position according to a fourth embodiment of the present invention.

Referring now to FIG. 32, cavity end 310, textured cord 320, cord cutout-a 321*a*, cord cutout-b 321*b*, and cap 330 are shown.

Figure 33:
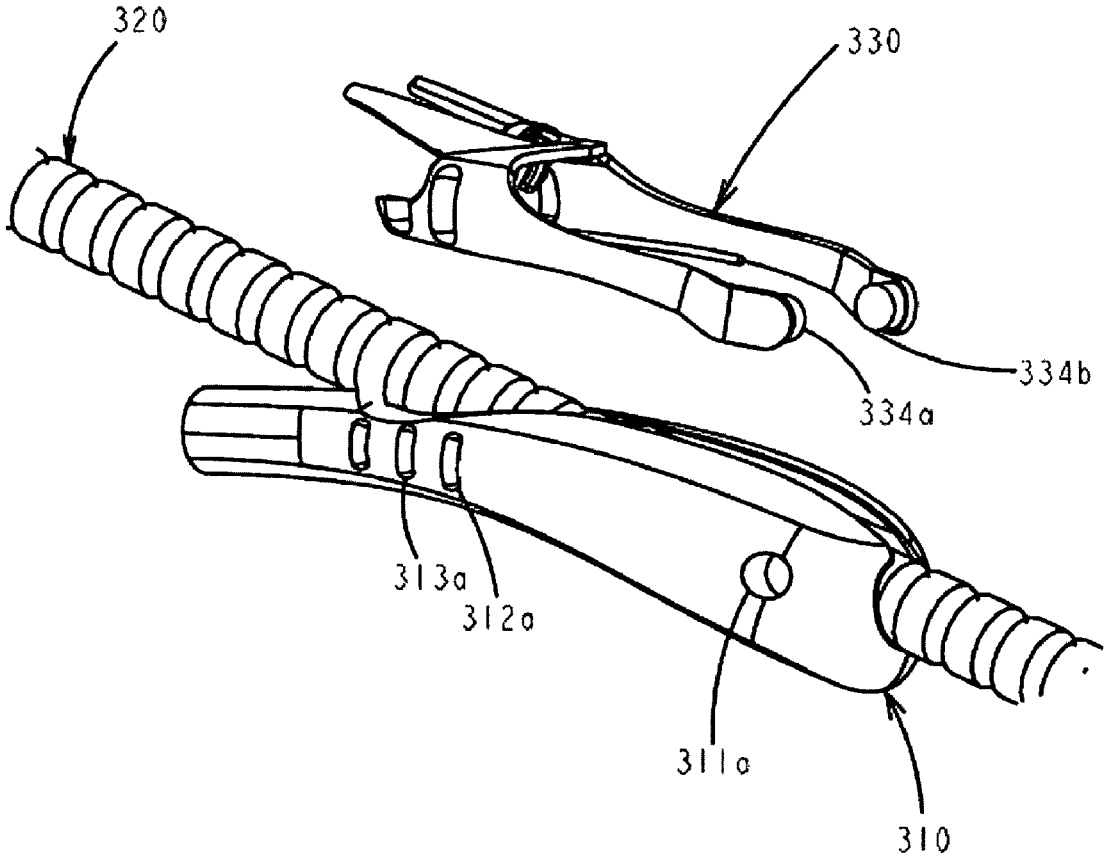
FIG. 33 is a partial exploded view of an adjustable bundling device according to a fourth embodiment of the present invention.

Referring now to FIG. 33, cavity end 310, small hole-a 311*a*, first finger grip-a 312*a*, second finger grip-a 313*a*, textured cord 320, cap 330, pivot protrusion-a 334*a*, and pivot protrusion-b 334*b* are shown.

Figure 34:
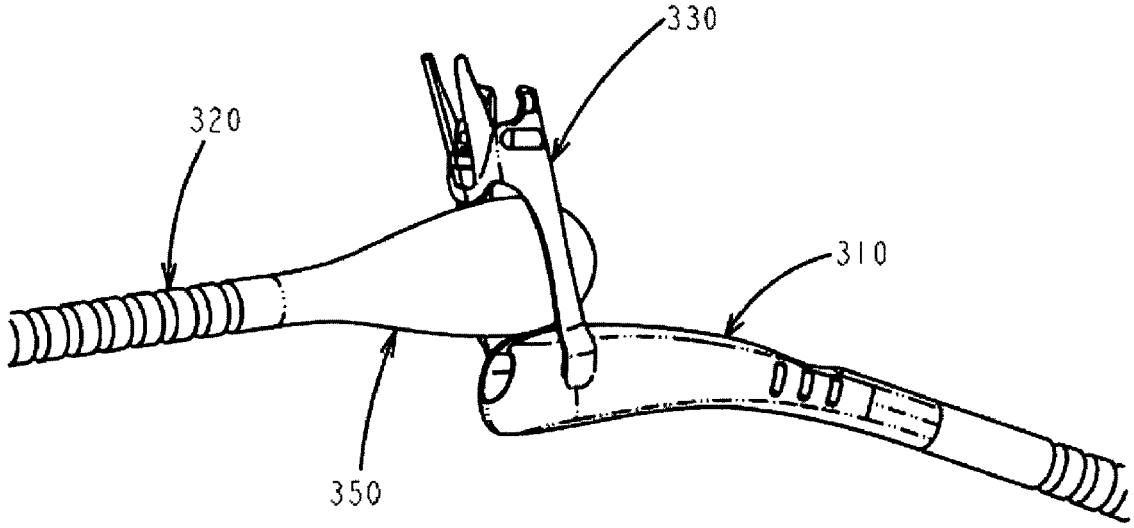
FIG. 34 is a partial view of an adjustable bundling device showing an intermediate step of placing the end stop through the cap in order to lock the adjustable bundling device according to a fourth embodiment of the present invention.

Referring now to FIG. 34, cavity end 310, textured cord 320, cap 330, and stop end 350 are shown.

Figure 35:
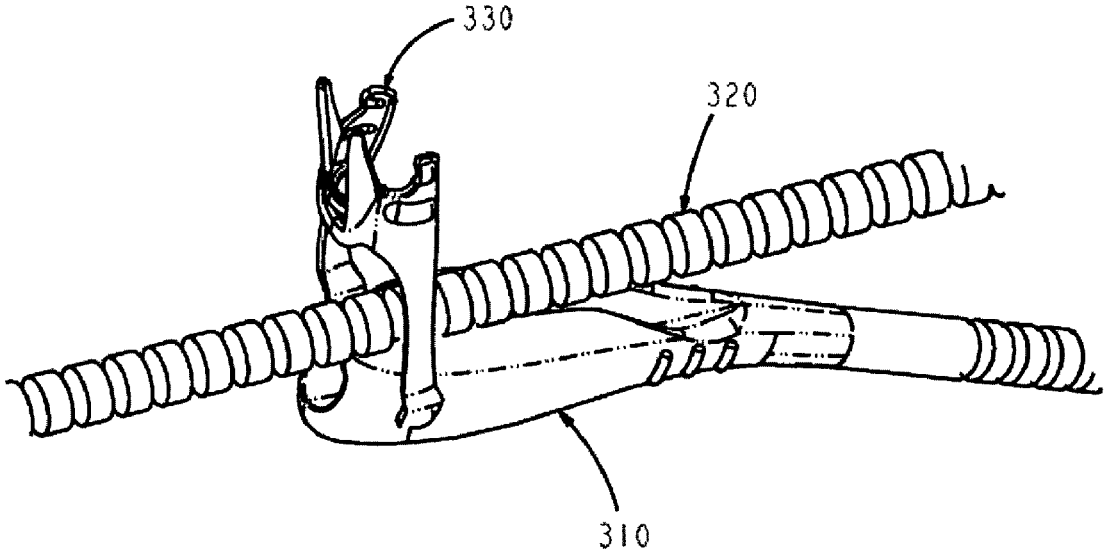
FIG. 35 is a partial view of an adjustable bundling device showing the next intermediate step of placing the cord on top of the cavity in order to lock the adjustable bundling device according to a fourth embodiment of the present invention.

Referring now to FIG. 35, cavity end 310, textured cord 320, and cap 330 are shown.

Figure 36:
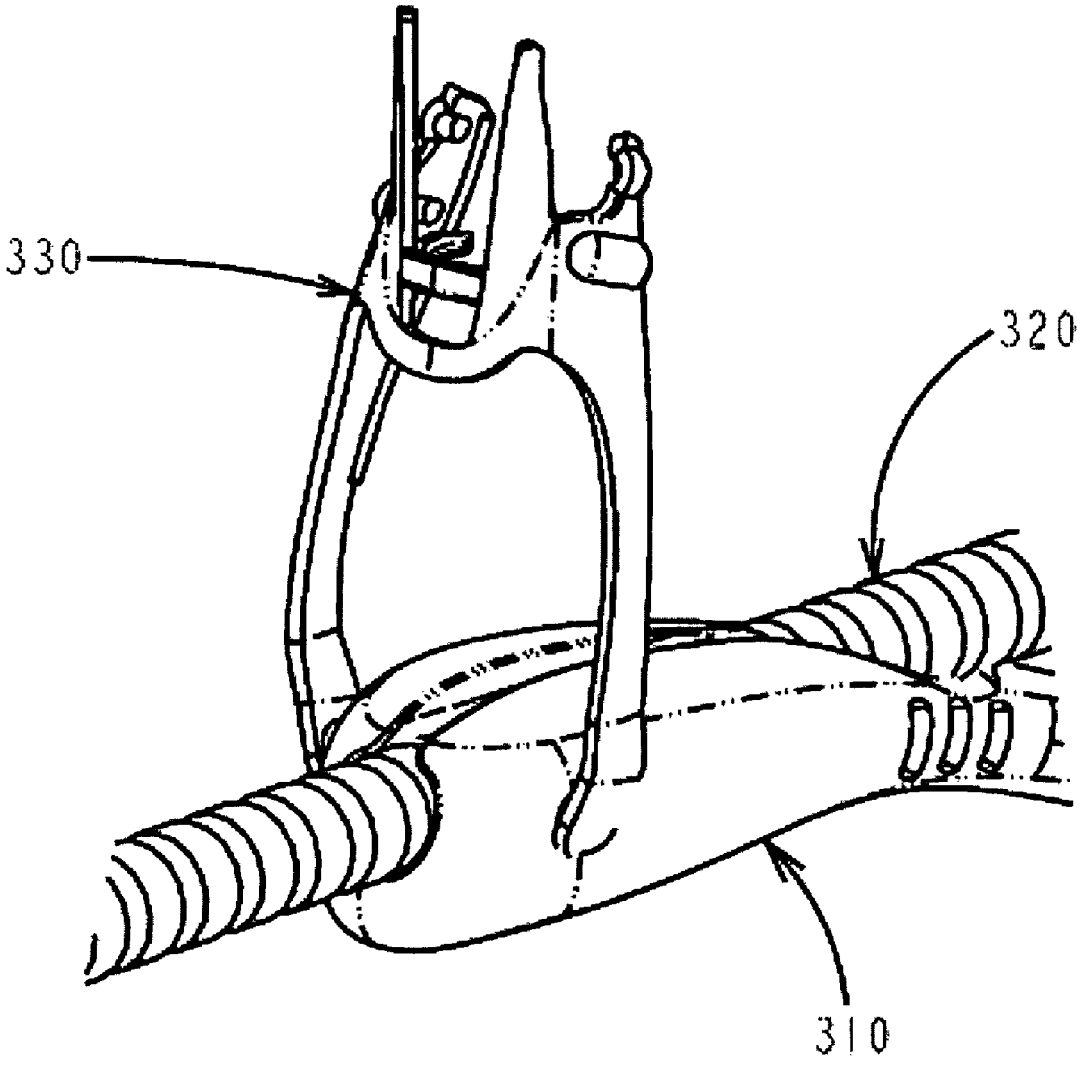
FIG. 36 is a partial view of an adjustable bundling device showing the next intermediate step of placing the cord into the cavity in order to lock the adjustable bundling device according to a fourth embodiment of the present invention.

Referring now to FIG. 36, cavity end 310, textured cord 320, and cap 330 are shown.

Figure 37:
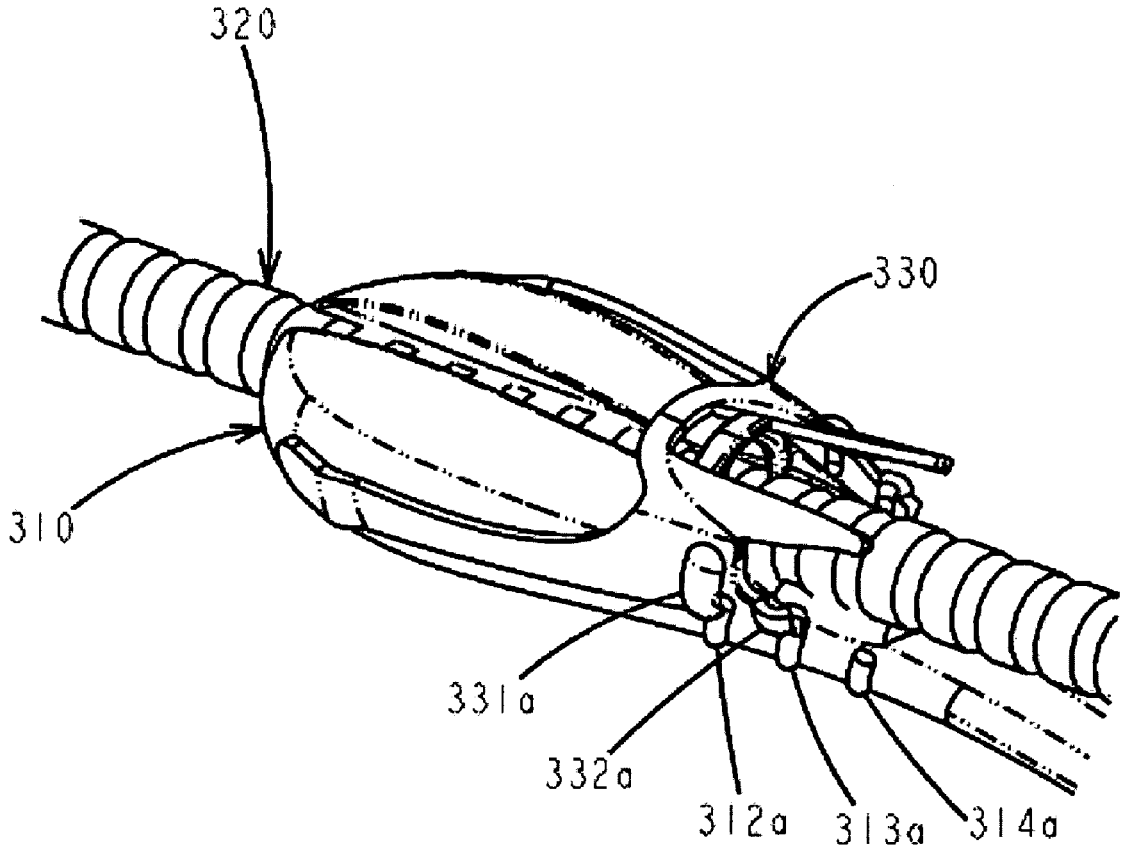
FIG. 37 is a partial view of an adjustable bundling device showing the final step in locking the adjustable bundling device according to a fourth embodiment of the present invention.

Referring now to FIG. 37, cavity end 310, first finger grip-a 312*a*, second finger grip-a 313*a*, third finger grip-a 314*a*, textured cord 320, cap 330, finger grip cutout full-a 331*a*, and finger grip cutout partial-a 332*a* are shown.

Figure 38:
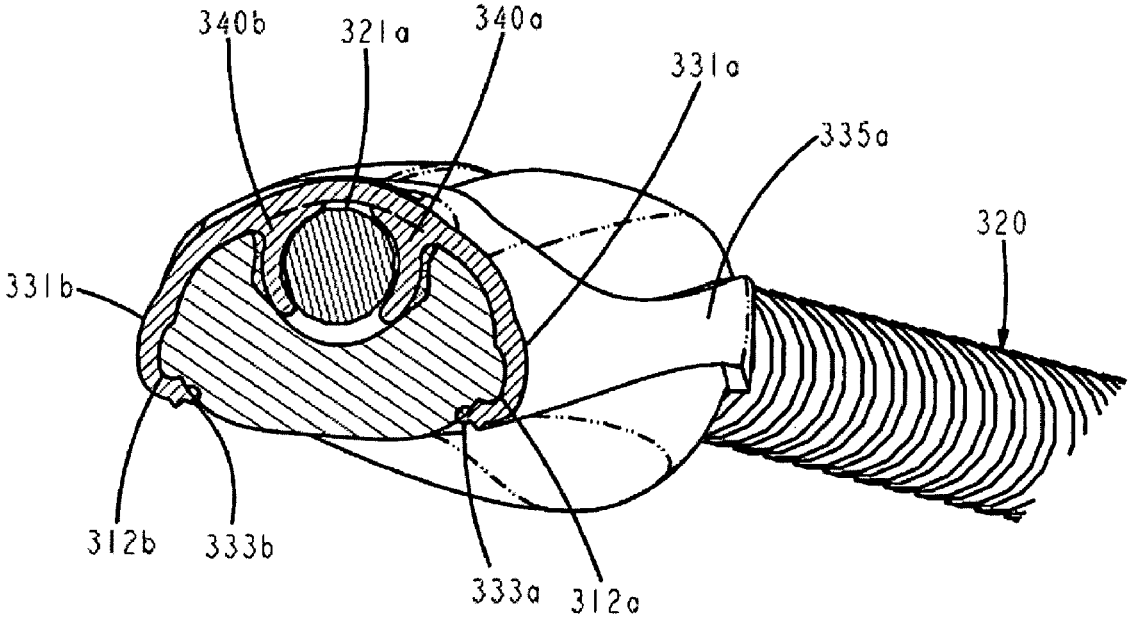
FIG. 38 is a partial view of an adjustable bundling device showing a longitudinal section that highlights the fang element cap lock according to a fourth embodiment of the present invention.

Referring now to FIG. 38, first finger grip-a 312*a*, second finger grip-b 312*b*, textured cord 320, cord cutout-a 321*a*, finger grip cutout full-a 331*a*, finger grip cutout full-b 331*b*, side bar-a 333*a*, side bar-b 333*b*, linkage-a 335*a*, fang-a 340*a*, and fang-b 340*b* are shown.

Figure 39:
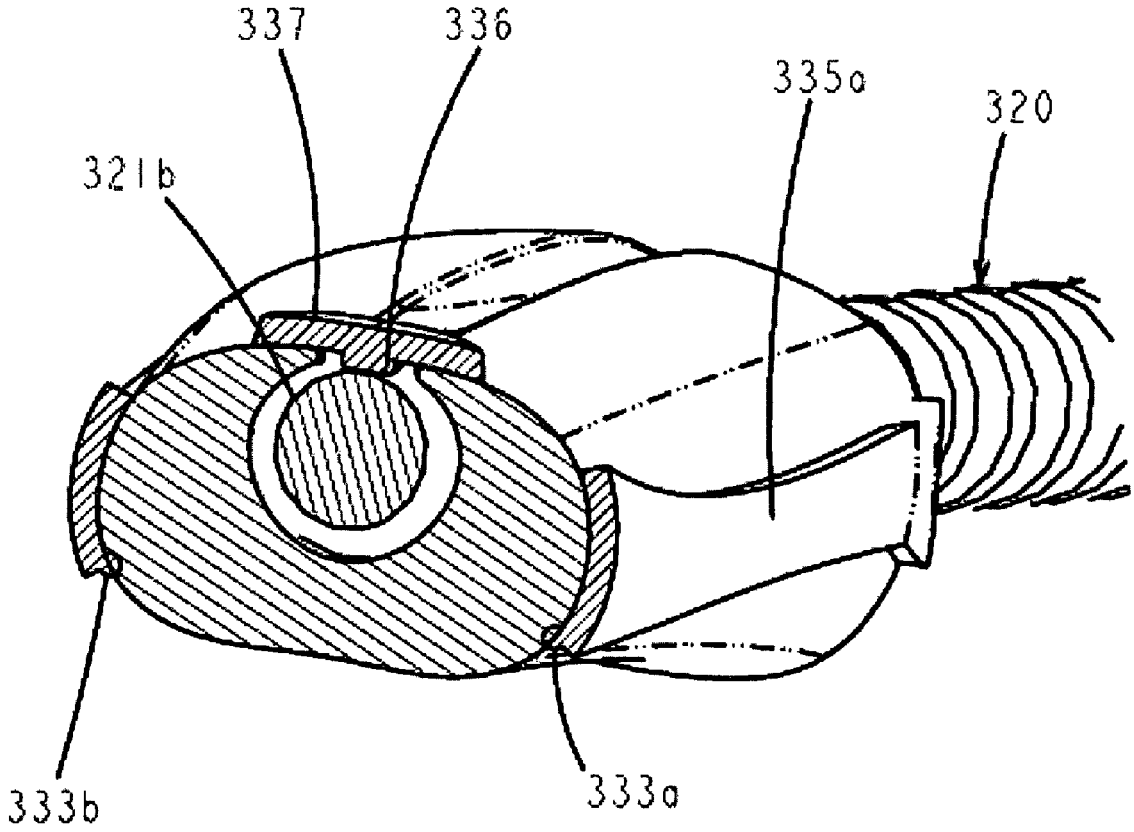
FIG. 39 is a partial view of an adjustable bundling device showing a longitudinal section highlighting the protrusion element cap lock according to a fourth embodiment of the present invention.

Referring now to FIG. 39, textured cord 320, cord cutout-b 321*b*, side bar-a 333*a*, side bar-b 333*b*, linkage-a 335*a*, mating protrusion 336, and mating bar 337 are shown.

Figure 40:
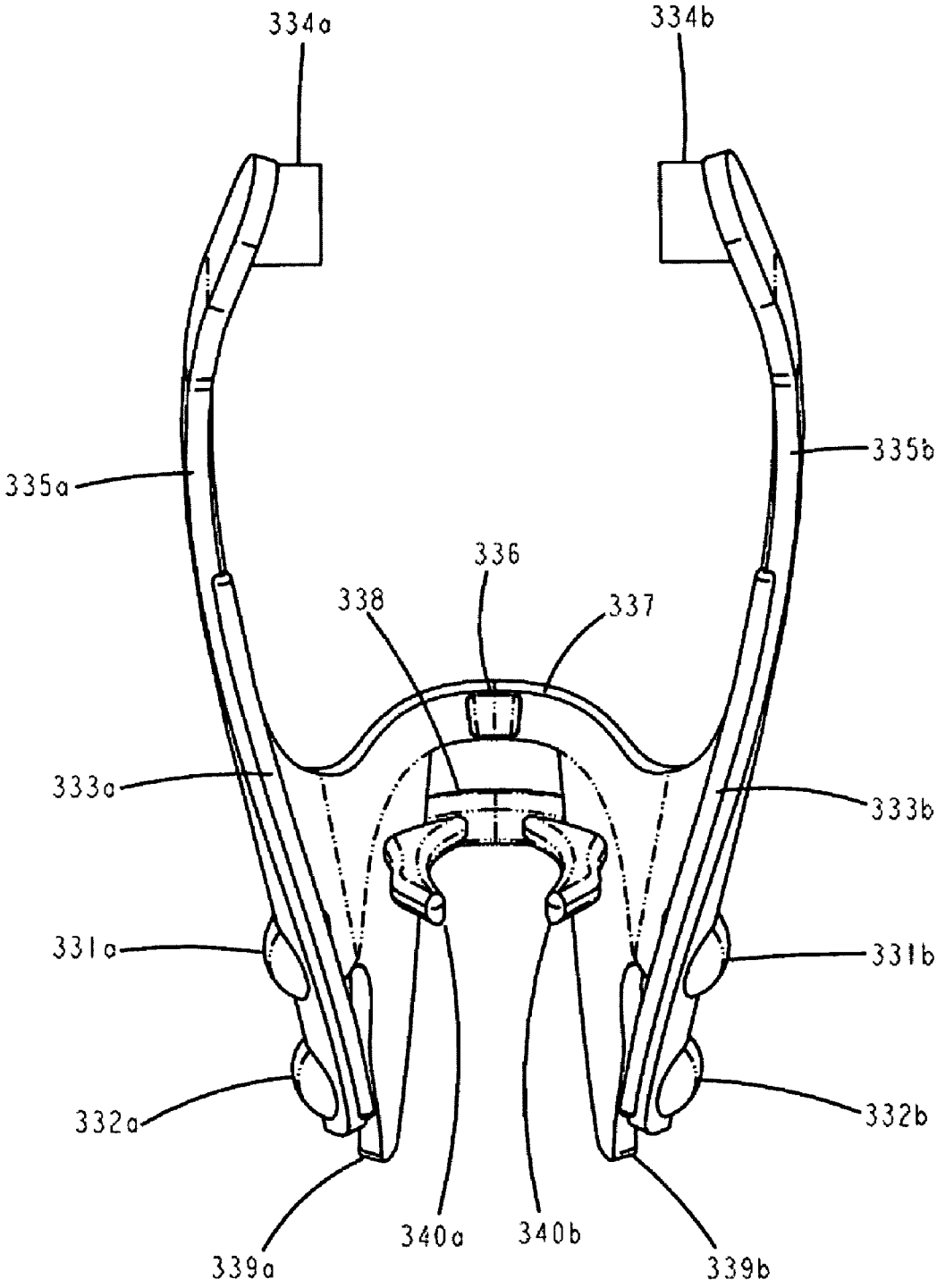
FIG. 40 is a plan partial view of an adjustable bundling device showing the inside of the cap element according to a fourth embodiment of the present invention.

Referring now to FIG. 40, finger grip cutout full-a 331*a*, finger grip cutout full-b 331*b*, finger grip cutout partial-a 332*a*, finger grip cutout partial-b 332*b*, side bar-a 333*a*, 21 side bar-b 333*b*, pivot protrusion-a 334*a*, pivot protrusion-b

334*b*, linkage-a 335*a*, linkage-b 335*b*, mating protrusion 336, mating bar 337, fang bar 338, finger bar-a 339*a*, finger bar-b 339*b*, fang-a 340*a*, and fang-b 340*b* are shown.

Figure 41:
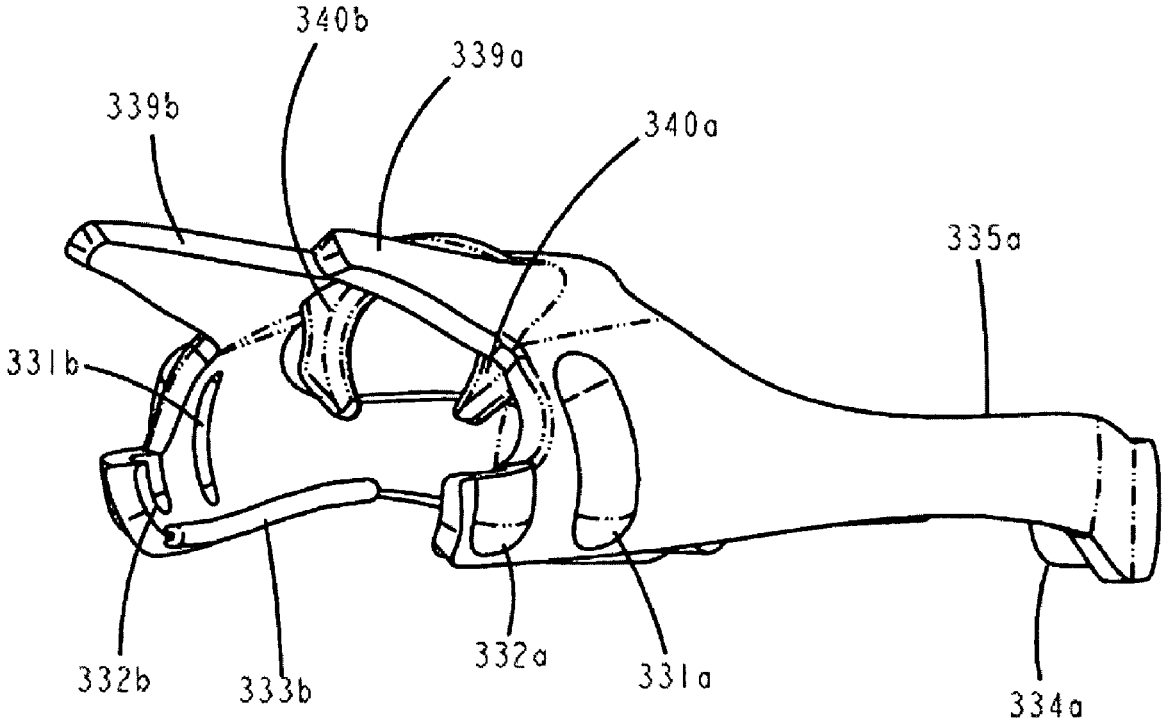
FIG. 41 is a partial view of an adjustable bundling device showing the cap element according to a fourth embodiment of the present invention.

Referring now to FIG. 41, finger grip cutout full-a 331*a*, finger grip cutout full-b 331*b*, finger grip cutout partial-a 332*a*, finger grip cutout partial-b 332*b*, side bar-b 333*b*, linkage-a 335*a*, finger bar-a 339*a*, finger bar-b 339*b*, fang-a 340*a*, and fang-b 340*b*, are shown.

Figure 42:
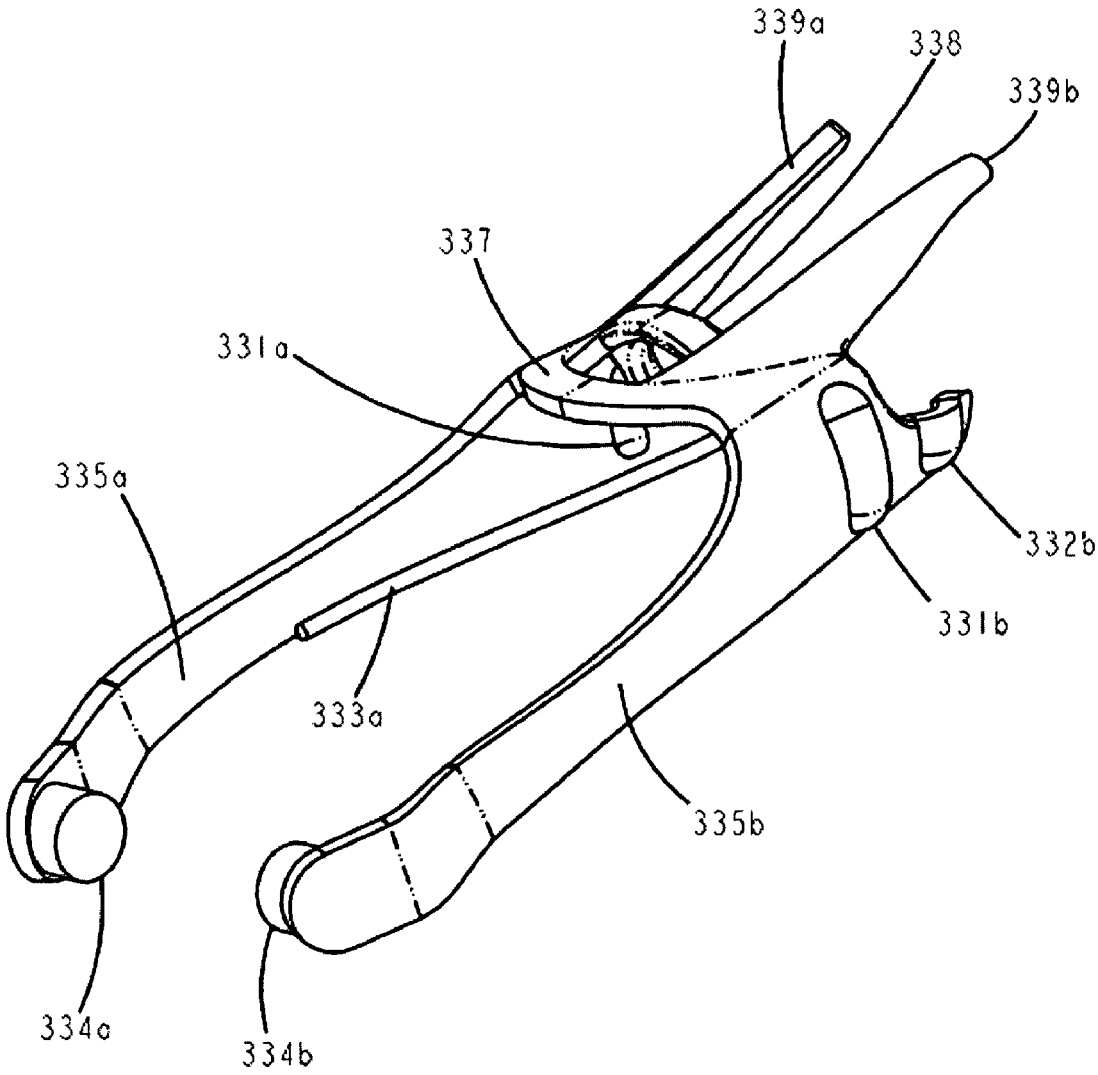
FIG. 42 is a partial view of an adjustable bundling device showing the cap element according to a fourth embodiment of the current invention.

Referring now to FIG. 42, finger grip cutout full-a 331*a*, finger grip cutout full-b 331*b*, finger grip cutout partial-b 332*b*, side bar-a 333*a*, pivot protrusion-a 334*a*, pivot protrusion-b 334*b*, linkage-a 335*a*, linkage-b 335*b*, mating bar 337, fang bar 338, finger bar-a 339*a*, and finger bar-b 339*b* are shown.

In the preferred embodiment the adjustable bundling device is comprised of textured cord 30, cavity end 20 and stop 40.

In the preferred embodiment the adjustable bundling device is typically manufactured from a specific type of heat-resistant silicon. A two-part mold cavity of the geometry is created using industry standard methods and silicon is poured into a mold cavity. The mold is then opened and the adjustable bundling device removed. In the preferred embodiment, textured cord 30, cavity end 20 and stop 40 are all made from the same heat-resistant silicon. However other materials, e.g., stainless aircraft cable, cast stainless steel, other types of silicon, rubber or other material combinations, can be used.

FIG. 2 through FIG. 6 and FIG. 9 show how a portion of textured cord 30 can be inserted into cavity end 20. Textured cord 30 is operable to enter and exit cavity end 20 in a direction normal to the axial length of textured cord 30 as shown in FIG. 4.

Cavity end 20 is preferably permanently attached at one end of textured cord 30 in such a way that another section of textured cord 30 can be 'looped' and routed into cavity end 20 as shown in FIG. 5 and FIG. 6. Textured cord 30 is of a length relative to the size of cavity end 20 that looping or noosing of textured cord 30 is possible. In the preferred embodiment, textured cord 30 length is approximately 14 inches. After textured cord 30 physically enters into interior cavity 26, textured cord 30 is held in place relative until the user removes it with moderate force. Additionally, textured cord 30 device can be axially pulled through interior cavity 26 of cavity end 20 to increase and decrease the size of the 'loop' formed as shown in FIG. 5 and FIG. 6. Additionally, stop 40 prevents the cord from passing out of the interior cavity 26 axially.

The common use of the preferred embodiment of an adjustable bundling device is as follows. Take the adjustable bundling device and lay it on a flat surface with interior cavity 26 facing down and place object 10 to be wrapped or cinched in the center of the adjustable bundling device as shown in FIG. 2. Lift cavity end 20 and stop 40 in the direction of the arrows and curve around object 10 with textured cord 30 as shown in FIG. 3. Continue to bring cavity end 20 and stop 40 together until they meet as shown in FIG. 4. Press with thumb and forefingers in the direction of the arrows to insert texture cord 30 into the cavity 26. Pressing textured cord 30 against cavity end 20 opens flexible edge-a 22*a* and flexible edge-b 22*b* of interior cavity 26 in such a way that it releases back cord lock-a 23*a*, back cord lock-b 23*b*, front cord lock-a 24*a*, and front cord lock-b 24*b* due to the mechanical linking of the material as shown in FIG. 7. Once textured cord 30 is within interior cavity 26, back cord lock-a 23*a* and front cord lock-a 24*a* keep textured cord 30 from slipping out the top of interior cavity 26 as shown in FIG. 9. Textured cord 30 is guided out of the front and end of the interior cavity 26 with front cord guide 27 and back cord guide 29.

To tighten the loop, grip cavity end 20 and stop 40 and pull in the direction of the arrows as shown in FIG. 5. As the cord is moved through the cavity, cord indentions 31 in textured cord 30, and mating protrusion-a 21*a* and mating protrusion-b 21*b* in cavity end 20 intersect and mesh, creating a tactile click and locking the cord into place laterally, allowing the adjustable bundling device to tighten as shown in FIG. 6 and stay in position. Additionally, finger grip 25, and raised branding area 41 facilitate a positive grip for the user.

The physical principles used to lock the cord into cinching position include friction of cord against the cavity walls, partial encasement of the cord, indentions in the flexible cord combined with protrusions in the interior of the cavity end, particular flexing of the cavity end for sliding, and particular flexing of the cavity end for insertion Along the entire length of interior cavity 26 textured cord 30 is interference fit. Because cavity end 20 is typically more flexible than textured cord 30, cavity end 20 deflects to allow textured cord 30 to enter. Inserting textured cord 30 deforms cavity end 20. Spring-back of the material of cavity end 20 forces the sidewalls of interior cavity 26 against textured cord 30 as shown in FIG. 9. Friction acts along the entire inside surface of the interior cavity 26 where it interfaces with textured cord 30. This friction acts to prevent axial sliding of textured cord 30 along interior cavity 26.

The cord is also retained within in the cavity by a function of partial encasement and particular flexing of the cavity as shown in FIG. 9. When the cord is forced through the opening of the cavity as in FIG. 4 with force in the direction of the arrows, the cavity flexes at flexible edge-a 22*a* and flexible edge-b 22*b* to allow the cord to enter. When flexible edge-a 22*a* and flexible edge-b 22*b* are pushed open by the cord, locking features at the beginning of cavity end 20, i.e., front cord lock-a 24*a* and front cord lock-b 24*b*, and at the end of cavity end 20, i.e., back cord lock-a 23*a*, back cord lock-b 23*b*, open, allowing textured cord 30 to slide in place in the cavity. After entering, flexible edge-a 22*a* and flexible edge-b 22*b* reform around the cord as shown in FIG. 9, keeping textured cord 30 locked into interior cavity 26 until textured cord 30 is forcibly removed. Thickened sections at the beginning of interior cavity 26, i.e. front cord lock-a 24*a* and front cord lock-b 24*b* and end of interior cavity 26, i.e., back cord lock-a 23*a* and back cord lock-b 23*b* serve as locking features to retain textured cord 30 in interior cavity 26.

To keep textured cord 30 from siding within interior cavity 26, indentions in textured cord 31 and mating protrusion-in interior cavity 26 interact and mesh. The mating protrusion-a 21*a* and mating protrusion-b 21*b* are shown in FIG. 8. When textured cord 30 is slid down interior cavity 26 axially, mating protrusions and indentions act as a series of stops, allowing the loop or noose to be changed in size, tightened around one or more objects, or loosened to release one or more objects.

The second preferred embodiment of an adjustable bundling device is shown in FIG. 10 through FIG. 21. This embodiment operates similarly to the adjustable bundling device shown in FIG. 1 through FIG. 9 but is preferably created out of stainless steel instead of a silicon blend. The actions in FIG. 2 through FIG. 6 are identical using this embodiment to cinch around an object.

To create this embodiment of an adjustable bundling device, a slide form tool is used to form cavity end 130 separately as shown in FIG. 17 through FIG. 19. A stamping tool is created and used to form stop end 110 out of stainless steel which is formed and permanently attached to textured cord 120. Cavity end 130 and stop end 110 are preferably approximately 1" in length, 0.5" wide and 0.5" deep. Textured cord 120 is preferably 0.0625" diameter of spirally wound stainless steel aircraft cable. The free end of textured cord 120 is placed through bottom cord area 141 of inner cavity 142 in the manner shown in FIG. 11 through FIG. 13. Textured cord 120 is then welded in bottom weld area 133 and front weld area 140 as shown in FIG. 16 to secure textured cord 120 to cavity end 130.

The functional attributes differ slightly from the preferred embodiment shown in FIG. 1 through FIG. 10. In order to secure textured cord 120 into cavity end 130, textured cord 120 is placed against and between lock lip-a 136*a* and lock lip-b 136*b* of cavity end 130 as shown in FIG. 20 and FIG. 21. Textured cord 120 is then pressed into cavity 130 using thumb and forefinger.

Pressing textured cord 120 drives cavity end 130 open, flexing back upper hinge-a 143*a* and back upper hinge-b 143*b* as shown in FIG. 21, allowing textured cord 120 to penetrate the inner cavity and flex lower curve hinge-a 138*a* and lower curve hinge-b 138*b*. Back upper hinge-a 143*a* and back upper hinge-b 143*b* have a wider initial gap than front upper hinge-a 144*a* and front-upper hinge-b 144*b*. The difference is that the initial gap allows the cord to be inserted easier in the back section than in the front section. As textured cord 120 enters from the back of the cavity and proceeds to enter the front of the cavity, it spreads the front upper hinges allowing the cord to fit within the entirety of inner cavity 142. These front and back upper hinges are an integral part of the same hinge structure; it helps to explain the function to separate them into front and back elements.

At this point, textured cord 120 presses towards locking protrusions 135*a*, 135*b*, 135*c*, 135*d*, 135*e*, 135*f*, curve hinge-a 138*a* and curve hinge-b 138*b* flex, locking protrusions 135*a*, 135*b*, 135*c*, 135*d*, 135*e*, 135*f* move away from textured cord 120, and textured cord 120 drops past the locking protrusions 135*a*, 135*b*, 135*c*, 135*d*, 135*e* 135*f* and into inner cavity 142. Spring-back of cavity end 130, preferably made from stainless steel, attempts to return cavity end 130 to its original shape and causes friction along the entire length of bottom cord area 141 which acts to hold textured cord 120 in place.

To slide textured cord 120 within bottom cord area 141 to tighten objects with this embodiment of the adjustable bundling device, hold cavity end 130 by fingergrips 131*a*, 131*b*, 131*c*, 131*d*, 131*f* with thumb and forefinger against outer wall 139 or front wall-a 137*a* and front wall-b 137*b* and pull textured cord 120 and stop end 110 until the cord loop is sufficiently decreased in diameter to clench/cinch the object desired.

The cord is held in place along inner cavity 142 by spiral stop 134. Spiral stop 134 acts on the spiral wrapping of textured cord 120, which is preferably made of aircraft cable. Additionally, spiral stop 134 provides both auditory and tactile feedback as spiral stop 134 moves in and out of the texture of the cord causing curve hinge-a 138*a* and curve hinge-b 138*b* to flex.

The third preferred embodiment of this invention is shown in FIG. 22 through FIG. 31. This embodiment operates similarly to the previous two with respect to clenching objects and therefore utilizes the same actions to clench items, e.g. food, as in FIG. 2 through FIG. 6. The locking mechanism in this embodiment has a few different functional elements.

To create the third embodiment of an adjustable bundling device, an injection molding cavity is used to create the device that is shown in FIG. 22. Cord 210 and cavity end 220 are attached as shown. The preferred material is a proprietary high-temperature thermoplastic. This embodiment uses a much stiffer plastic than the previous embodiments. Cord 210 has a plurality of spherical protrusions 211*a*, 211*b*, 211*c* along the length of cord 210. Connecting these spherical protrusions are short cylinders 212*a*, 212*b*, and 212*c* dimensioned to be of a smaller diameter than the spheres.

Referring FIGS. 23 and 24, a close up view of cavity end 220 is shown. Inner cavity 222 helps guide cord 210. Outside protrusions 221*a*, 221*b*, 221*c*, 221*d*, 221*f* act as finger grips as this embodiment of the adjustable bundling device is often used with greasy or wet objects. Cavity lip-a 225*a* and cavity lip-b 225*b* act on short cylinders 212*a*, 212*b*, 212*c* of cord 210, and the slot that is formed is slightly narrower than the cylinders. Spherical cut 223 acts on spherical protrusions 212*a*, 212*b*, 212*c* on cord 210 since spherical cut 223 is of a slightly smaller diameter than spherical protrusions 212*a*, 212*b*, 212*c*. Sloped lip sections-a 226*a* and sloped lip section-b 226*b* act to guide cord 210 into inner cavity 222 and help align cord 210 so it may be pressed into inner cavity 222. Inner protrusions 224*a*, 224*b*, 224*c*, 224*d*, 224*e*, 224*f*, 224*h* help lock spherical protrusions 212*a*, 212*b*, 212*c* and cord 210 in place axially after cord 210 is placed into the cavity.

FIG. 25, FIG. 26 and FIG.-27 show cord 210 in inner cavity 222. Spherical protrusion 211*g* is of slightly larger diameter than the spherical cut 223, requiring the user to insert cord 210 into inner cavity 222 with force to overcome friction and mechanical resistance. Additionally, cavity lip-a 225*a* and cavity lip-b 225*b* form an opening slightly smaller than short cylinder-g 212*g* and short cylinder-h 212*h*, requiring finger force from the user to insert the cord into the cavity.

To insert cord 210 into cavity end 220, place cord 210 over the cavity lips as shown in FIG. 28 and FIG. 29. Align spherical protrusion 211*g* over spherical cut 221 using the mating shapes as tactile guidance. When these are aligned, press cord 210 into inner cavity 222 using thumb and forefingers. The mechanical friction will make insertion difficult, but will keep the two parts from coming undone until removal is desired.

In order to increase or decrease the degree of clenching of this embodiment of an adjustable bundling device, slide cord 210 axially along inner cavity 222. An additional mechanism is used in this embodiment to keep the adjustable bundling device axially locked as shown in FIG. 30 and FIG.-31. Internal protrusions 224*a*, 224*b*, 224*c*, 224*d*, 224*e*, 224*f*, 224*h* mate and engage with spherical protrusions 211*a*, 211*b*, 211*c*, 211*d*, 211*e*, 211*f*, 211*g* as cord 210 is slid up and down inner cavity 222 locking cord 210 in place axially.

The fourth preferred embodiment of the present invention is shown in FIG. 32 through FIG. 42. This embodiment operates similarly to the previous three with respect to clenching objects and therefore utilizes similar actions to clench food as shown in FIG. 2 through FIG. 6. The locking mechanism in this embodiment has a few different functional elements.

To create this embodiment, an injection molding cavity is used to create the adjustable bundling device as shown in FIG. 40 through FIG. 42. The material used is a stiff plastic, e.g., Nylon. The thickness of the plastic wall is preferably approximately 0.020 inches. The same process is used to create this embodiment as is shown in FIG. 1.

First, small hole-a 311*a* and small hole-b 311*b* (not shown) are formed in cavity end 310 as shown in FIG. 33. These small hole-a 311*a* and small hole-b 311*b* mate with pivot protrusion-a 334*a* and pivot protrusion-b 334*b* in cap 330. Textured cord 320 is used as described in the first embodiment. Other than cap 330, this embodiment has identical functionality of the first embodiment.

Linkage-a 335*a* and linkage-b 335*b* link the locking elements of cap 330 with the pivot protrusion-a 334*a* and pivot protrusion-b 334*b*. The length of these linkages is such that stop end 350 can pass through with minimal difficulty as shown in FIG. 34.

FIG. 34 through FIG. 37 show how cap 330 is secured around cavity end 310. In FIG. 37 and FIG. 38, fang-a 340*a* and fang-b 340*b* are shown mating with cord cutout-a 321*a*. Fang-a 340*a* and fang-b 340*b* wrap around the cord cutouts as shown in FIG. 38, both locking cap 330 down around cavity end 310 and preventing textured cord 320 from sliding axially within cavity end 310. Fang bar 338 holds fang-a 340*a* and fang-b 340*b* in place and also holds the left and right side of cap 330 together.

In FIG. 37 and FIG. 39, mating protrusion 336 is shown mating with cord cutout 321*b*. The intersection of these two elements helps prevent textured cord 320 from sliding axially within cavity end 310. Mating protrusion 336 is held in place by mating bar 337, which also holds the left and right sides of cap 330 together.

An additional method of keeping cap 330 locked is shown in FIG. 38 through FIG. 42. Side bar-a 333*a* and side bar-b 333*b* press into the flexible material of cavity end 310. Using the friction and the spring back properties of both cap 330 and flexibility of cavity end 310, assists in the locking of cap 330 into place.

An additional method of keeping cap 330 locked is shown in FIG. 37 through FIG. 42. First finger grip-a 312*a* and first finger grip-b 312*b* and second finger grip a 313*a* and second finger grip-b 313*b* are used as a locking device when finger grip cutout full-a 331*a* and finger grip cutout full-b 331*b* and finger grip cutout partial-a 332*a* and finger grip cutout partial-b 332*b* are placed around them. This is shown in FIG. 38 in the cross-section view as 312*b* and side bar-b 333*b*, as well as 312*a* and side bar-a 333*a* fit tightly around each other. Using friction and spring back properties of both cap 330 and the flexibility of cavity end 310, helps to lock cap 330 into place.

In order to unlock cap 330 from cavity end 310, finger bar-a 339*a* and finger bar-b 339*b* are used. These elements allow the user a way to pull the cap off of the adjustable bundling device so whatever it is holding can be un-cinched.

Although the invention has been described herein with specific reference to a presently preferred and additional embodiments thereof, it will be appreciated by those skilled in the art that various modifications, deletions, and alterations may be made to such preferred embodiment without departing from the spirit and scope of the invention. In this regard, it is believed that the clenching device may be sized and configured to be utilized in any of a variety of clenching operation as a substitute for conventional clenching devices. For example, it is contemplated that clenching device of the present invention may be sized and adapted for use in large scale applications such as load tie down for a car or truck or sized and adapted for small scale applications such as food preparation, or adapted to encase non-related implements such as a lighting apparatus which can then be clinched around an object to allow for hands-free illumination. Accordingly, it is intended that all reasonably foreseeable additions, modifications, deletions and alterations be included within the scope of the invention as defined in the following claims.

What is claimed is:

1. An adjustable bundling device comprising:

a cord made from a flexible material and including a plurality of protrusions that extend over at least a portion of the cord, wherein each protrusion extends continuously around the circumference of the cord and has a center axis that is common with the lengthwise cord axis; and a cavity having a plurality of protrusions and comprising a first and second flexible edge defining the cavity opening and operable to receive the cord into the cavity, the first and second flexible edges also being operable to substantially encase the cord, and the plurality of protrusions in said cavity only covering a portion of the interior wall surface of the cavity.

2. The adjustable bundling device of claim 1, wherein a set of protrusions in said cavity are in alignment with each other such that adjacent protrusions on the cord can rest on opposing sides of the set of protrusions.

3. The adjustable bundling device of claim 1, wherein the protrusions in said cavity include at least two protrusions on each of the opposing sides of the interior wall surface of the cavity.

4. The adjustable bundling device of claim 3, wherein the cord can be retracted from said cavity by pulling the cord against the first and second flexible edges defining the cavity opening.

5. The adjustable bundling device of claim 4, wherein the cavity comprises a first opening that is proximate to the cord, and a second opening that is distal to the cord.

6. An adjustable bundling device comprising:

a cord made from a flexible material and including a plurality of protrusions that extend over at least a portion of the cord, wherein each protrusion extends continuously around the circumference of the cord and has a center axis that is common with the lengthwise cord axis;

a cavity formed on one end of the cord and comprising:

a first and second flexible edge defining a cavity opening operable to receive the cord into the cavity, the first and second flexible edges also being operable to substantially encase the cord, and a plurality of protrusions with each protrusion only covering a portion of the interior wall surface of the cavity; and a stop formed on an opposing end of the cord from the cavity, the stop having a larger diameter than the cavity such that the stop cannot be pulled through the cavity.

7. The adjustable bundling device of claim 6, wherein the stop is tear-drop shaped.

8. The adjustable bundling device of claim 6, wherein at least one set of protrusions in said cavity are in alignment with each other such that adjacent protrusions on the cord can rest on opposing sides of the at least one set of protrusions and, the symmetry of the protrusions allow the cord to be inserted into the cavity in either direction.

9. The adjustable bundling device of claim 6, wherein the protrusions in said cavity include at least two protrusions on opposing sides of the interior wall surface of the cavity such that when the cord is placed into the cavity, each of the protrusions align with a space between two protrusions on the cord.

10. The adjustable bundling device of claim 9, wherein the cord can be retracted from said cavity by pulling the cord against the first and second flexible edges defining the cavity opening.

11. An adjustable bundling device comprising:

a cord made from a flexible material and including a plurality of protrusions that extend over at least a portion of the cord and being concentric to the cord;

a cavity formed on one end of the cord and comprising:

a first and second flexible edge defining a cavity opening operable to receive the cord into the cavity, the first and second flexible edges also being operable to substantially encase the cord, a first opening that is proximate to the cord, and a second opening that is distal to the cord;

wherein the cord can be inserted into the cavity by pulling the cord against an outer side of the first and second flexible edges, the cord can be slid within the cavity in first direction by applying opposing forces to the cord proximate to the cavity and the cavity and in a second direction by applying opposing forces to the portion of the cord distal to the cavity and the cavity, and the cord can be extracted from the cavity by pulling the cord against an inner side of the first and second flexible edges.

12. The adjustable bundling device of claim 11, wherein the cavity includes an interior wall that extends from the first flexible edge to the second flexible edge and further includes a plurality of protrusions with each protrusion only extending over a portion of the interior wall surface of the cavity.

13. The adjustable bundling device of claim 12, wherein a set of protrusions in said cavity are in alignment with each other such that adjacent protrusions on the cord can rest on opposing sides of the set of protrusions.

14. The adjustable bundling device of claim 12, wherein the protrusions in said cavity include at least two protrusions on substantially opposing sides of the interior wall surface of the cavity.

15. An adjustable bundling device comprising:

a cord with a circular cross-section made from a flexible material and including a plurality of spherical protrusions that extend beyond the circumference of at least a portion of the cord, wherein a center axis of each spherical protrusion is common with the lengthwise cord axis; and a cavity having a plurality of protrusions and comprising a first and second flexible edge defining the cavity opening and operable to receive the cord into the cavity, the first and second flexible edges also being operable to substantially encase the cord, and the plurality of protrusions in said cavity only covering a portion of the interior wall surface of the cavity.

* * * * *